US012740644B2

(12) United States Patent
Dunn, Jr.

(10) Patent No.: US 12,740,644 B2
(45) Date of Patent: Sep. 22, 2026

(54) DEVICE FOR STABILIZING AN OBJECT

(71) Applicant: Gregory J. Dunn, Jr., Needham, MA (US)

(72) Inventor: Gregory J. Dunn, Jr., Needham, MA (US)

( * ) Notice: Subject to any disclaimer, the term of this patent is extended or adjusted under 35 U.S.C. 154(b) by 0 days.

(21) Appl. No.: 18/768,192

(22) Filed: Jul. 10, 2024

(65) Prior Publication Data

US 2025/0017378 A1 Jan. 16, 2025

Related U.S. Application Data

(60) Provisional application No. 63/525,883, filed on Jul. 10, 2023.

(51) Int. Cl.
*A47C 7/00* (2006.01)
*A47C 7/62* (2006.01)

(52) U.S. Cl.
CPC ..... *A47C 7/002* (2013.01); *A47C 7/62* (2013.01)

(58) Field of Classification Search
CPC ..... A47D 1/00; E01F 9/681; A47B 91/12
USPC ..... 248/188.9, 188.8, 188, 539, 540, 519; 297/463.1, 463.2
See application file for complete search history.

(56) References Cited

U.S. PATENT DOCUMENTS 200,317 A * 2/1878 Luce ..... A47B 91/04 248/188.9
388,981 A † 9/1888 La Barbe
1,158,350 A † 10/1915 White
1,386,947 A * 8/1921 Quinn ..... E01F 9/681 248/539
1,828,550 A * 10/1931 Sommers ..... A47C 9/00 108/154
2,409,622 A * 10/1946 Gottfried ..... A47C 7/002 248/188.9
2,496,556 A * 2/1950 Nelson ..... E04G 3/265 248/237
3,012,628 A * 12/1961 Zumbaum ..... E06C 7/423 182/172
3,987,996 A 10/1976 Yocca
4,118,002 A * 10/1978 Bartlett ..... F16M 11/42 248/311.2
4,261,138 A 4/1981 St. George Syms
4,519,477 A * 5/1985 Ralston ..... E06C 7/423 182/172
5,086,876 A * 2/1992 Severson ..... E06C 7/42 182/172
5,224,227 A 7/1993 McGinley
5,287,844 A * 2/1994 Fieber ..... A47J 37/0763 126/30
5,362,024 A * 11/1994 Grinnen ..... A47G 33/12 248/524
5,575,492 A * 11/1996 Stone ..... B60S 9/04 280/475

(Continued)

*Primary Examiner* — Nkeisha Smith
(74) *Attorney, Agent, or Firm* — Pandiscio & Pandiscio

(57) ABSTRACT

A stabilization device for preventing an object from falling backwards or sideways, the device comprising: an upright portion comprising an inner surface and an outer surface; a base portion mounted to the upright portion comprising at least one leg; and at least one stabilization arm, wherein the at least one stabilization arm is mounted to the upright portion and the base portion.

26 Claims, 39 Drawing Sheets

(56) References Cited

U.S. PATENT DOCUMENTS

| | | | | |
|---|---|---|---|---|
| 5,647,451 | A * | 7/1997 | Reichel | E04G 5/041 182/113 |
| 6,040,514 | A * | 3/2000 | Liao | G10D 13/28 84/421 |
| 6,227,513 | B1 * | 5/2001 | Richard | F16M 11/041 248/354.7 |
| 6,253,876 | B1 * | 7/2001 | Cosgrave | E06C 7/423 182/172 |
| 7,207,293 | B2 * | 4/2007 | Deming, Jr. | A01K 15/024 119/706 |
| 7,309,106 | B2 † | 12/2007 | Stallman | |
| 7,677,000 | B2 | 3/2010 | Walker | |
| 7,854,476 | B1 † | 12/2010 | Liu | |
| 8,011,724 | B2 * | 9/2011 | Clayton | A47C 7/002 280/30 |
| 8,375,858 | B2 * | 2/2013 | Steadman, Sr. | F42B 4/20 248/528 |
| 9,810,023 | B2 * | 11/2017 | Stewart | E06C 7/42 |
| 10,519,716 | B2 * | 12/2019 | Saxby | E06C 7/423 |
| 10,856,659 | B1 † | 12/2020 | Stravitz | |
| 11,974,671 | B1 | 5/2024 | Critchfield | |
| 12,178,322 | B1 | 12/2024 | Critchfield | |
| 2007/0170753 | A1 † | 7/2007 | Ference | |
| 2008/0314682 | A1 * | 12/2008 | Cogswell | E06C 7/46 182/108 |
| 2015/0130238 | A1 | 5/2015 | Meinecke | |
| 2016/0222729 | A1 * | 8/2016 | Shih | E06C 7/42 |

* cited by examiner
† cited by third party

DEVICE FOR STABILIZING AN OBJECT

REFERENCE TO PRIOR PATENT APPLICATION

This patent application claims benefit of prior U.S. Provisional Patent Application Ser. No. 63/525,883, filed Jul. 10, 2023 by Gregory J Dunn for CHAIR LEG STABILIZER ATTACHMENT FOR CHILDREN'S SAFETY.

The above-identified patent application is hereby incorporated herein by reference.

FIELD OF THE INVENTION

This invention relates to a device for stabilizing an object in general, and more particularly to a device for stabilizing the legs of a chair in order to prevent the chair from tipping backwards and/or falling sideways.

BACKGROUND OF THE INVENTION

The present invention relates to a device for stabilizing an object, particularly objects having legs which can fall backwards or sideways. It should be appreciated that a device which can be used on a variety of objects having a variety of leg-types is desirable so that a single device can be used to stabilize a large number of objects (e.g., chairs, pianos, dressers, etc.). Thus, with the present invention, a single device can be used around the home (or any other location) to prevent objects from falling backwards and or sideways.

It should also be appreciated that such a device is particularly useful for parents. Parents currently use a wide variety of childproofing and child-safe products to keep their children safe in the home. A problem faced by many parents is that many standard chairs (e.g., kitchen table chairs, kitchen island chairs, high chairs, etc.) easily tip completely backwards or fall sideways when a child is not sitting properly in the chair (i.e., when a child is standing on the chair and/or rocking in the chair, etc.).

Thus there is a need for a device which stabilizes the legs of a chair which is easy to attach to a chair leg, can be attached to any style of chair leg (e.g., straight, angled, etc.) and provides support to prevent a chair from falling backwards and/or from falling sideways when a child is playing on the chair and/or not sitting properly in the chair.

SUMMARY OF THE INVENTION

These and other objects are addressed by the provision and use of a new and improved device for stabilizing an object. In one preferred embodiment of the invention, the device is configured to stabilize the legs of an object. The device may be attached to any style of leg, is easy to attach (and remove), and prevents the object from falling backwards and/or falling sideways.

More particularly, in accordance with the present invention, there is provided a new and improved device for stabilizing the legs of an object which is designed to be positioned on a leg of the object. The new and improved device for stabilizing the legs of an object generally comprises an upright portion which is attached to a leg of an object, a base portion which contacts the floor and at least one stabilizing arm connected to the upright portion and the base portion.

In use, the device is releasably secured to a leg of an object, with the device making a secure fit against the leg. Then the device is secured to the leg using a strap or cable tie. A second device may then be secured to a second leg of the object in the same manner. Thus, when the present invention is used to stabilize a chair, when a child is sitting/standing on the chair, the chair will rock backwards/sideways slightly but will not completely fall backwards and/or sideways. When the device is no longer needed, the straps or cable ties are released and the device is removed from the leg(s) of the object, whereupon the device may be moved to another object or placed into storage.

In one form of the invention, there is provided a stabilization device for preventing an object from falling backwards or sideways, the device comprising:

- an upright portion comprising an inner surface and an outer surface;
- a base portion mounted to the upright portion comprising at least one leg; and
- at least one stabilization arm, wherein the at least one stabilization arm is mounted to the upright portion and the base portion.

In another form of the invention, there is provided a method for stabilizing an object, the method comprising:

- providing a stabilization device, the stabilization device comprising:
  - an upright portion comprising an inner surface and an outer surface;
  - a base portion mounted to the upright portion comprising at least one leg; and
  - at least one stabilization arm, wherein the at least one stabilization arm is mounted to the upright portion and the base portion;
- positioning the inner surface of the upright portion on an object; and
- securing the stabilization device to the object.

In another form of the invention, there is provided a chair stabilization system comprising:

- an adjustable upright portion comprising an inner surface and an outer surface, wherein the inner surface is configured for placement on a chair leg and the outer surface comprises at least one strap bridge configured to receive a strap;
- a base portion hingedly mounted to the upright portion comprising a first leg, a second leg and a track disposed in between the first leg and the second leg, wherein the base portion is configured for placement on a floor;
- a stabilization arm hingedly mounted to the upright portion comprising a mount configured to be releasably secured in the track of the base portion; and
- at least one strap configured to be held by the at least one strap bridge for securing the device to a leg of a chair.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

The Stabilization Device in General

Figure 1:
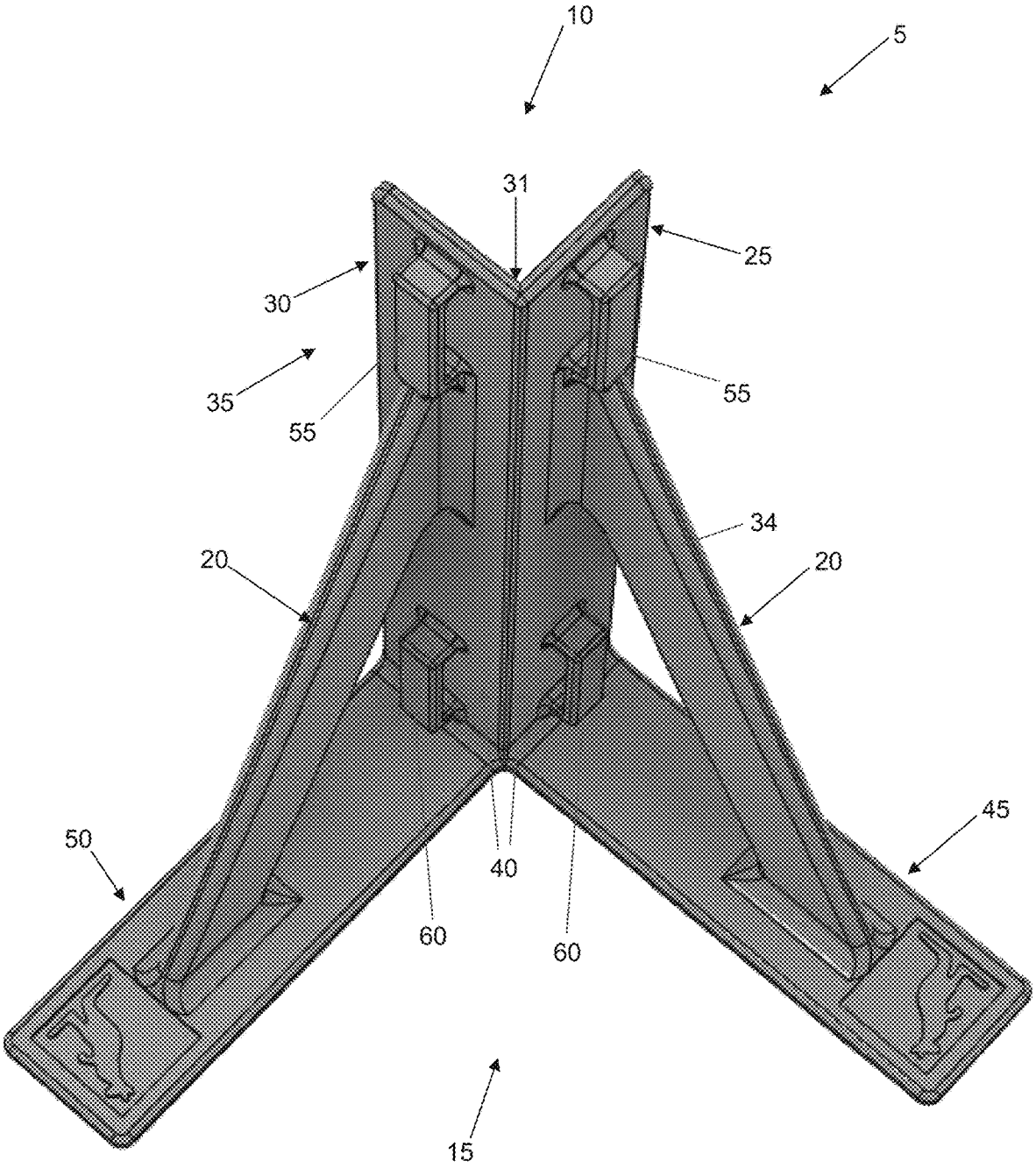
FIGS. 1-7 are schematic views showing a new and improved device for stabilizing an object formed in accordance with the present invention.
Figure 2:
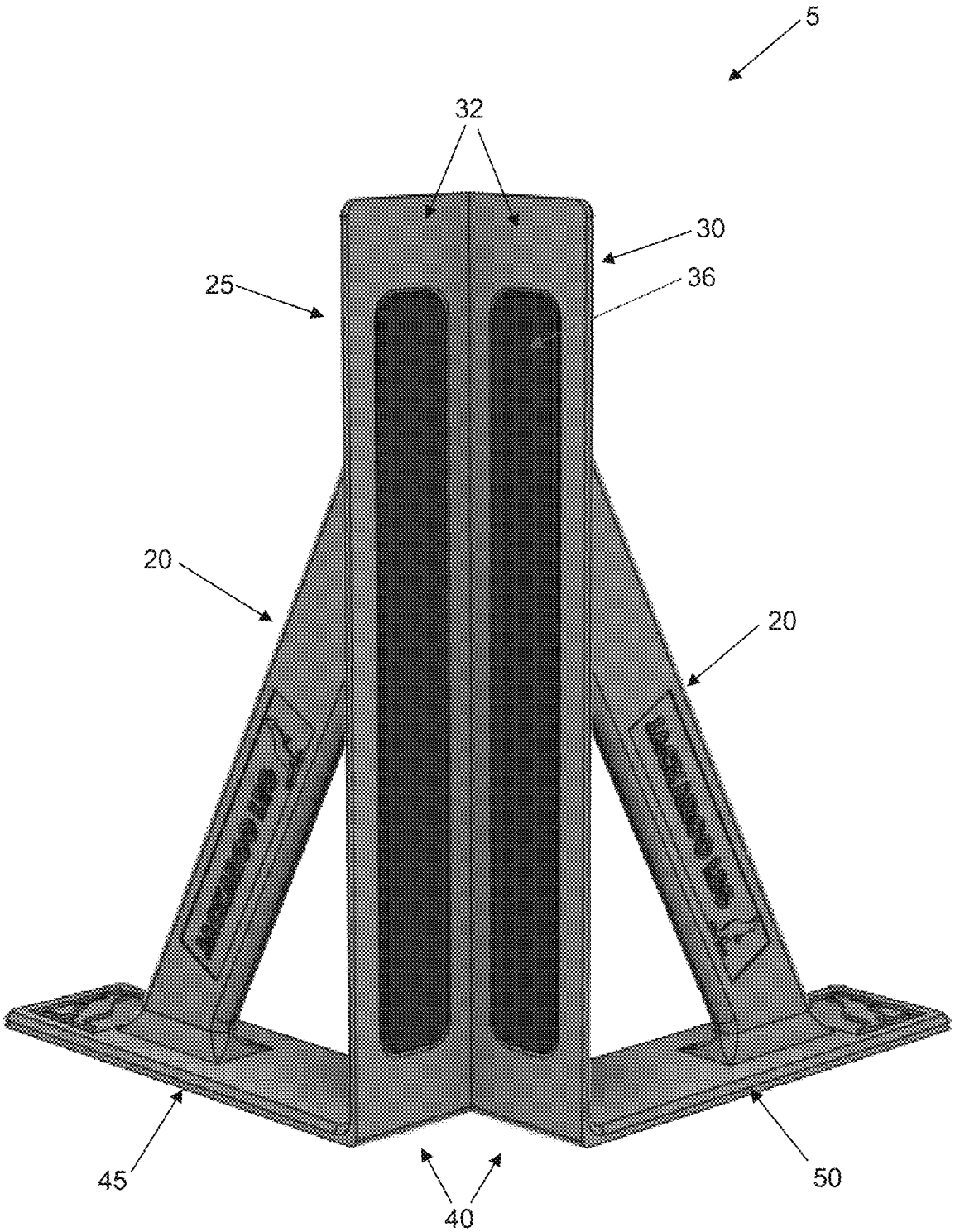
Figure 3:
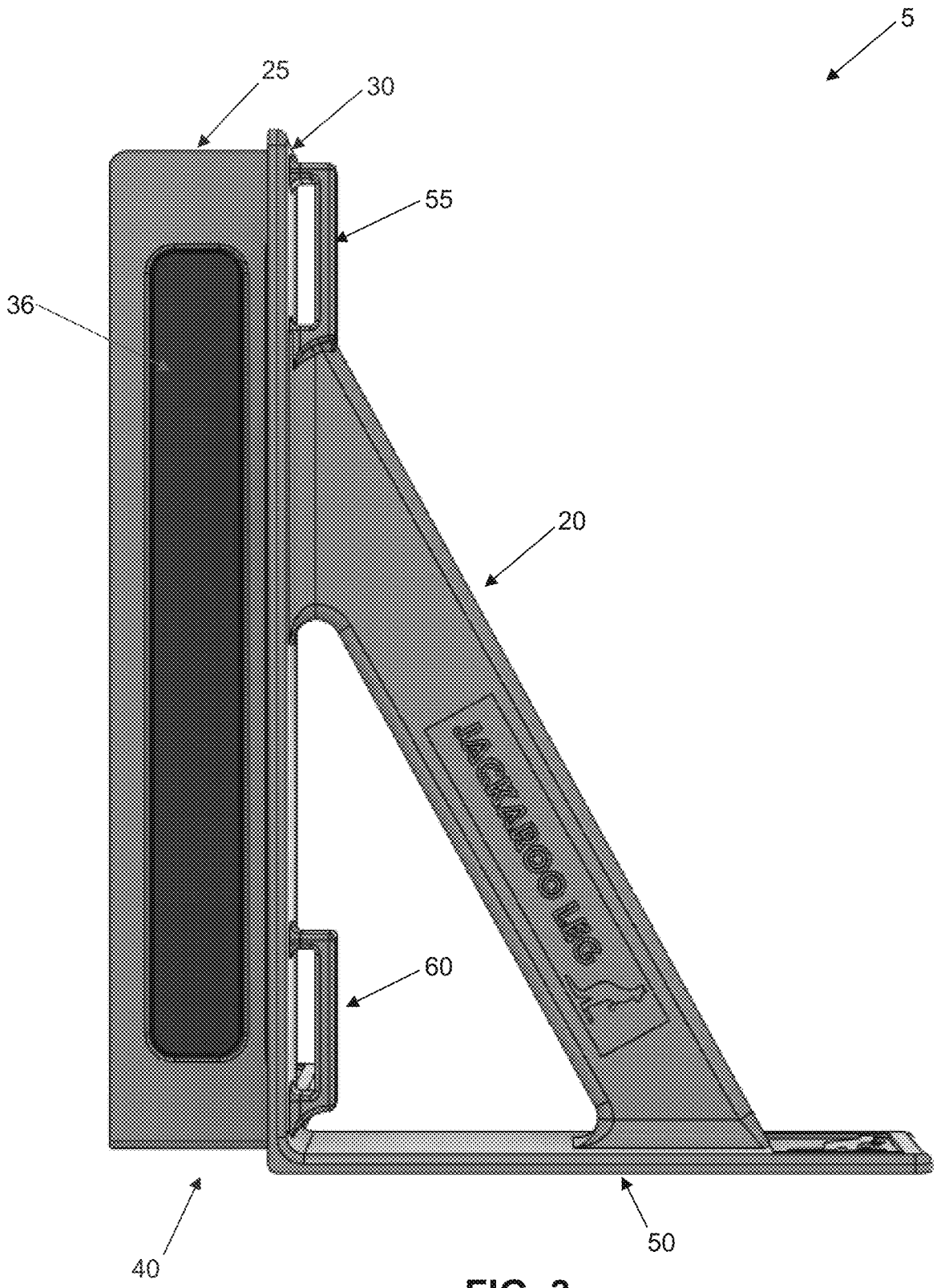
Figure 4:
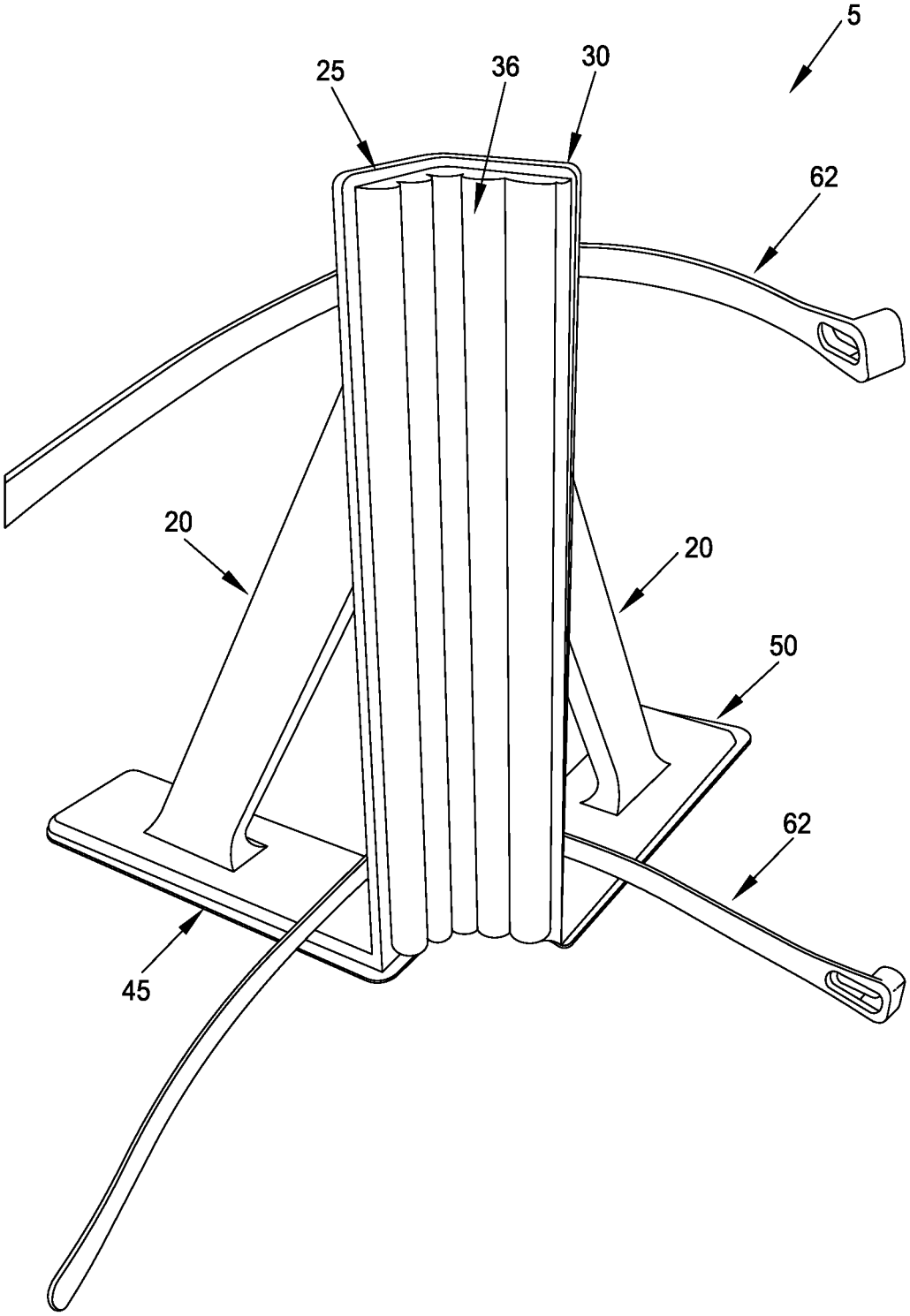
Figure 5:
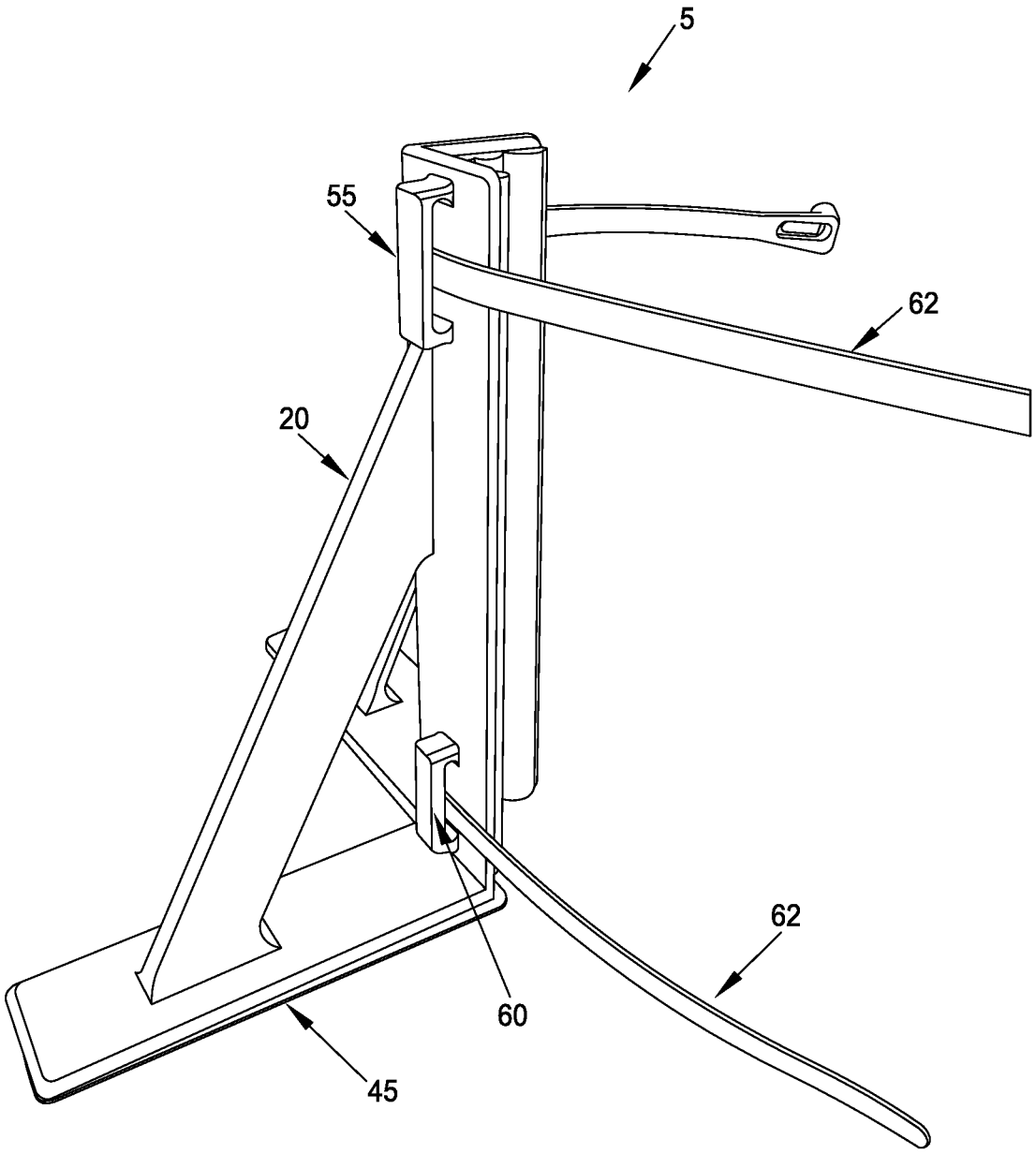
Figure 6:
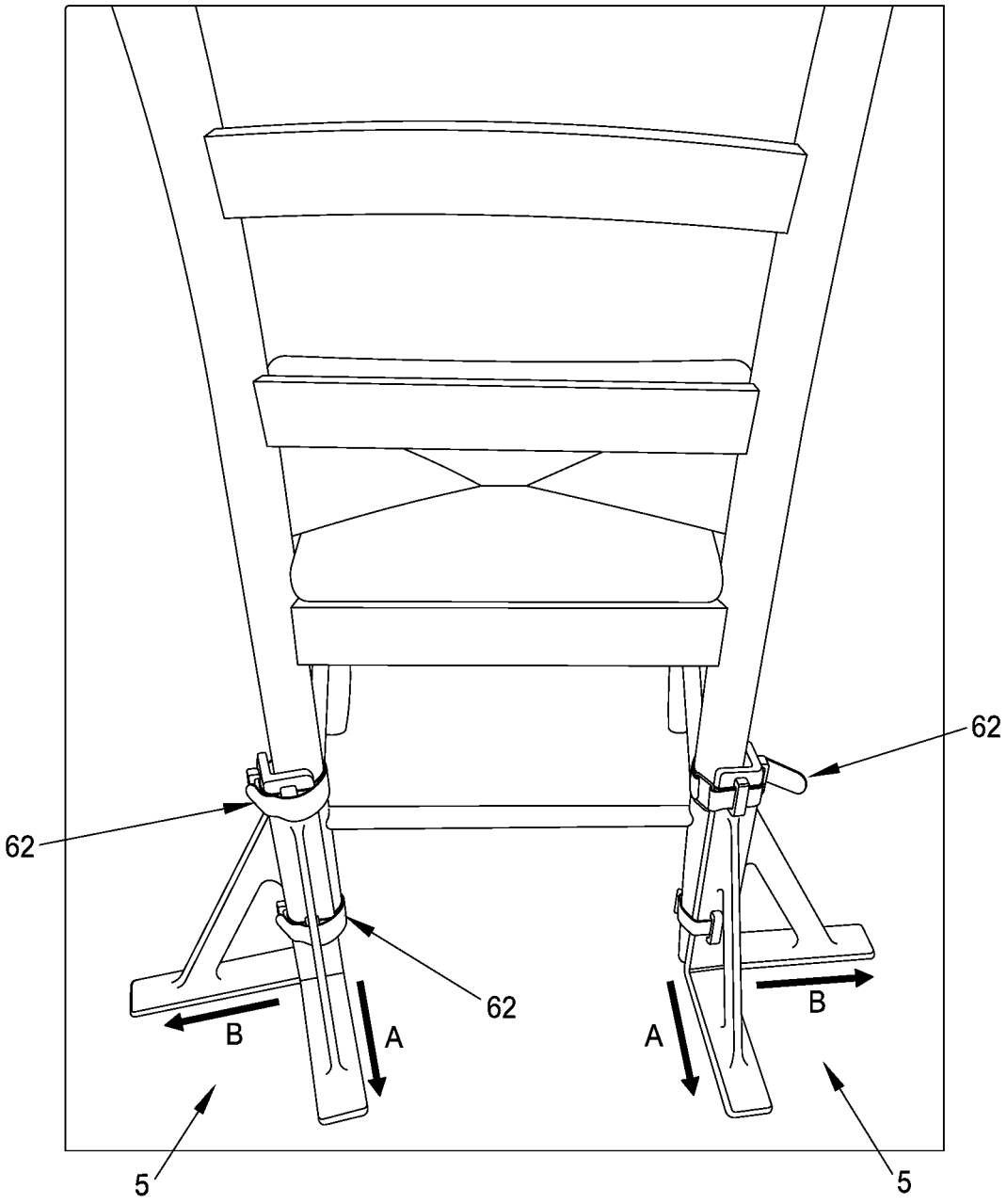
Figure 7:
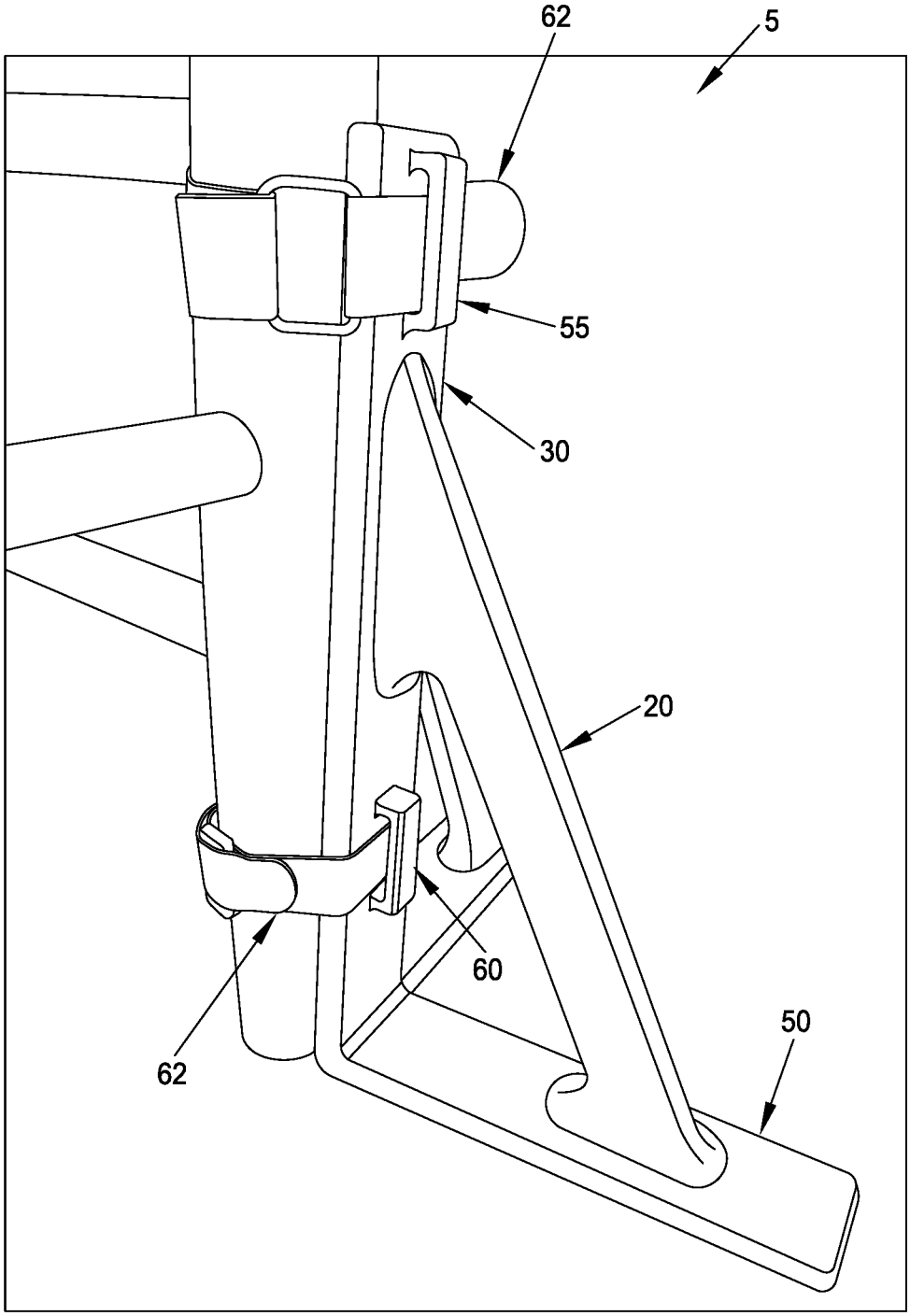

The present invention comprises the provision and use of new and improved device for stabilizing an object. In one preferred form of the invention, the device is configured to prevent an object from falling backwards or sideways. In one embodiment of the present invention, the device may be positioned on the back legs of a chair (or another object having legs, e.g., a piano, a dresser, etc.) so as to prevent the chair from tipping backwards and/or falling sideways when a person is sitting or standing on the chair. The device may be 3D printed and made of plastics, metals or composite materials (e.g., polyethylene terephthalate glycol (PETG), acrylonitrile butadiene styrene (ABS), polylactic acid (PLA), resin, stainless steel, titanium, nylon, etc.). The device may also be made by injection molding and formed from plastics or composite materials (e.g., polyethylene terephthalate glycol (PETG), acrylonitrile butadiene styrene (ABS), polypropylene, nylon, etc.). It should be appreciated that the present invention is not limited to the production processes and materials disclosed herein; any production process and any materials apparent to one of skill in the art in view of the present disclosure may be used.

In one preferred form of the invention, the device generally comprises an upright portion for disposition on a leg of an object, a base portion for disposition on the floor and at least one stabilization arm mounted to the base portion and the upright portion. The upright portion is intended to be releasably attached to a leg of an object. The base portion is designed to lay flat on any type of floor (e.g., wood, carpet, etc.). The stabilization arm acts as a support structure for handling the weight of an object (and, in the case of a chair, the weight of the chair and the person sitting/standing in the chair) when it tips backwards and/or sideways.

Device for Use with Objects Having Straight Legs

In one preferred form of the invention, the device is constructed for use with objects having straight legs. In a preferred embodiment of the invention, the device is formed as a single piece.

More particularly, and looking now at FIGS. 1-7, there is shown a new and improved device 5. Device 5 generally comprises an upright portion 10 for disposition on a leg of an object, a base portion 15 for disposition on a floor and at least one stabilization arm 20 mounted to upright portion 10 and base portion 15.

In this form of the invention, upright portion 10 comprises a first vertical portion 25 and a second vertical portion 30 which form a 90 degree angle at a seam 31. Each vertical portion 25, 30 has a top portion 35 and a bottom portion 40. Each vertical portion 25, 30 has an inner surface 32 for disposition on a leg of an object and an outer surface 34. If desired, inner surfaces 32 may be provided with a gripping material 36 (e.g., foam pads, tape, double sided Velcro®, furniture pad material, etc.) in order for the device 5 to better grip a leg of an object and/or protect a leg of an object from damage due to the attachment (and future removal) of a device 5.

Each outer surface 34 of top portion 35 comprises a strap bridge 55 and each outer surface 34 of bottom portion 40 also comprises a strap bridge 60. Strap bridges 55, 60 are configured so that a first strap 62 (e.g., Velcro®, cable ties, etc.) can be slid through strap bridges 55 on top portions 35, a second strap 62 can be slid through strap bridges 60 on bottom portions 40, and the straps can then be placed around a leg of an object (and possibly through the strap bridges a second time, depending on the length of the straps) and tightly fastened so as to secure the device 5 to a leg of an object (see FIGS. 4-7).

Base portion 15 comprises a first leg 45 and a second leg 50 which are connected to bottom portions 40 of vertical portions 25, 30 of upright portion 10 so as to form a 90 degree angle between legs 45, 50. In other words, vertical portion 25 is connected to leg 45 and vertical portion 30 is connected to leg 50. It should be appreciated that legs 45, 50 can be any length, width or height required for stabilization, however, legs 45, 50 must be configured to keep an object stable but not so long, wide or thick so as to protrude too far out from the object to be stabilized. In one embodiment of the present invention, legs 45, 50 may be thin and flexible so that legs 45, 50 can bend and slide along a floor thus providing further stability to device 5. Furthermore, if desired, the edges of legs 45, 50 may be rounded. In another embodiment of the present invention, legs 45, 50 may be rigid.

If desired, base portion 15 may comprise a material (not shown) for contacting the floor (e.g., furniture pad material, felt, etc.). It should be appreciated that, if desired, base portion 15 may comprise a single leg or more than two legs. Furthermore, base portion 15 may comprise straight edges or rounded edges.

A single stabilization arm 20 is mounted to each vertical portion 25, 30 and to the associated leg 45, 50 of that vertical portion 25, 30 (i.e., a stabilization arm 20 is mounted to vertical portion 25 and leg 45 and a second stabilization arm 20 is mounted to vertical portion 30 and leg 50). It should be appreciated that stabilization arm 20 absorbs the weight of the tipping object and adds stability to device 5.

Figure 9:
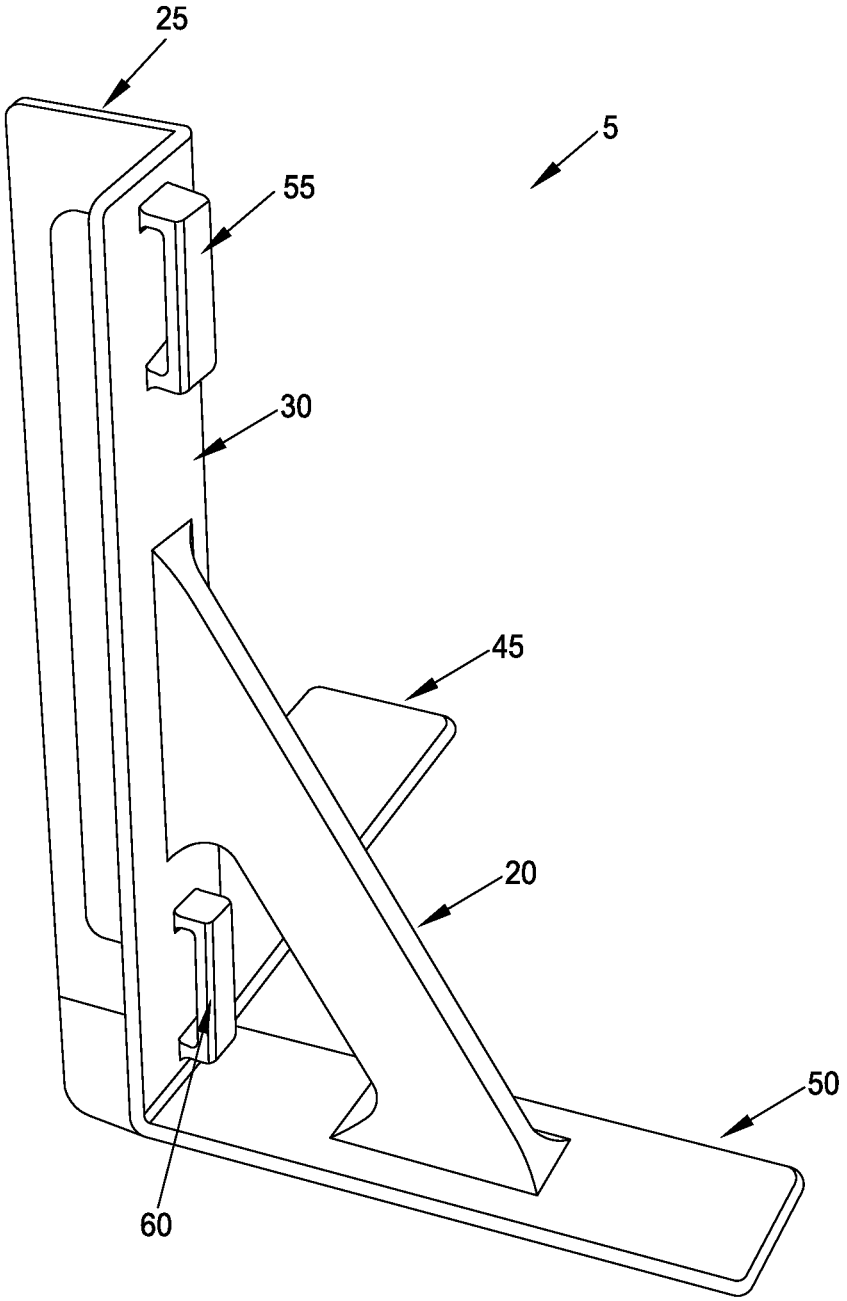
Figure 10:
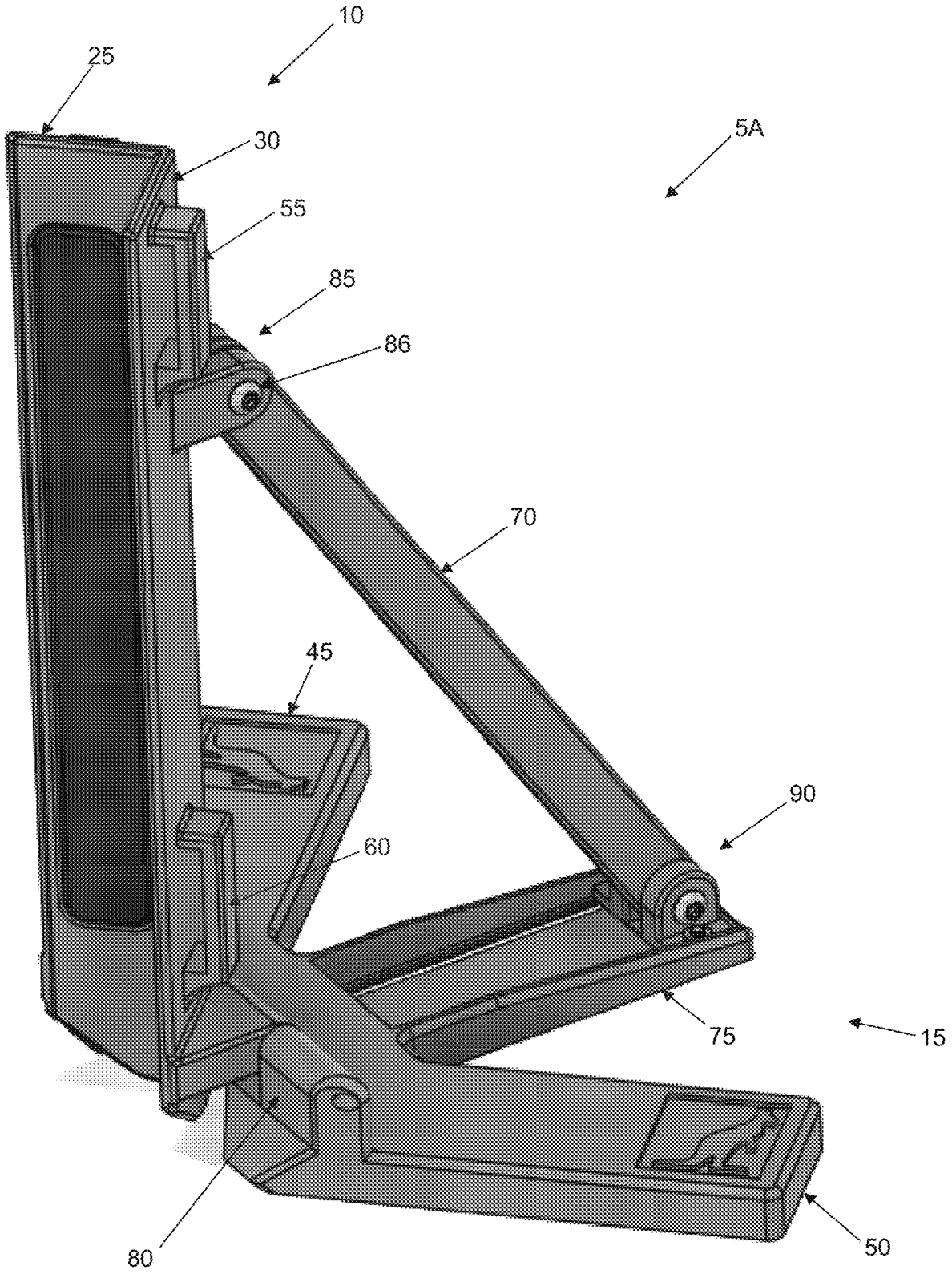
FIGS. 10-13 are schematic views showing another new and improved device for stabilizing an object formed in accordance with the present invention.
Figure 11:
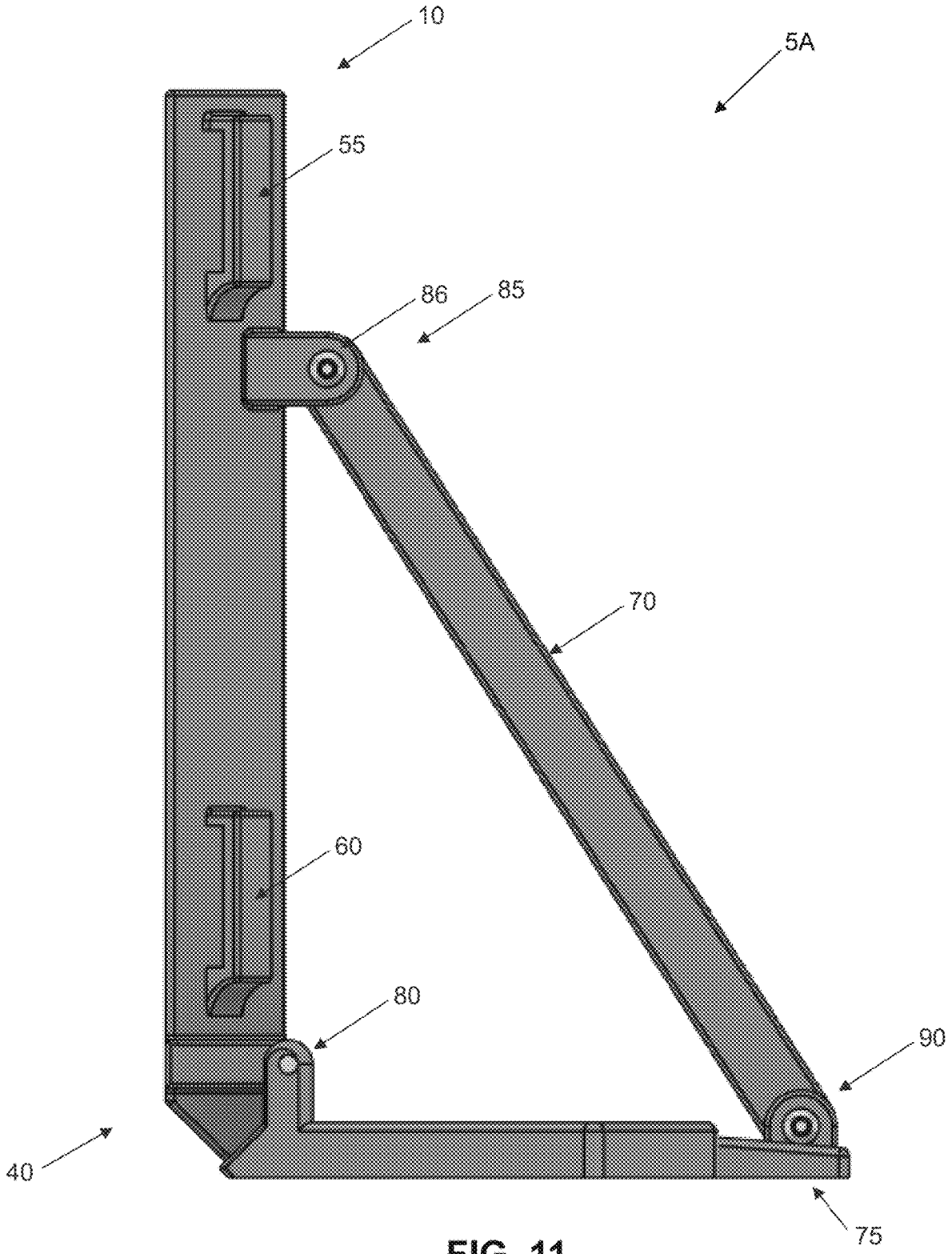
Figure 12:
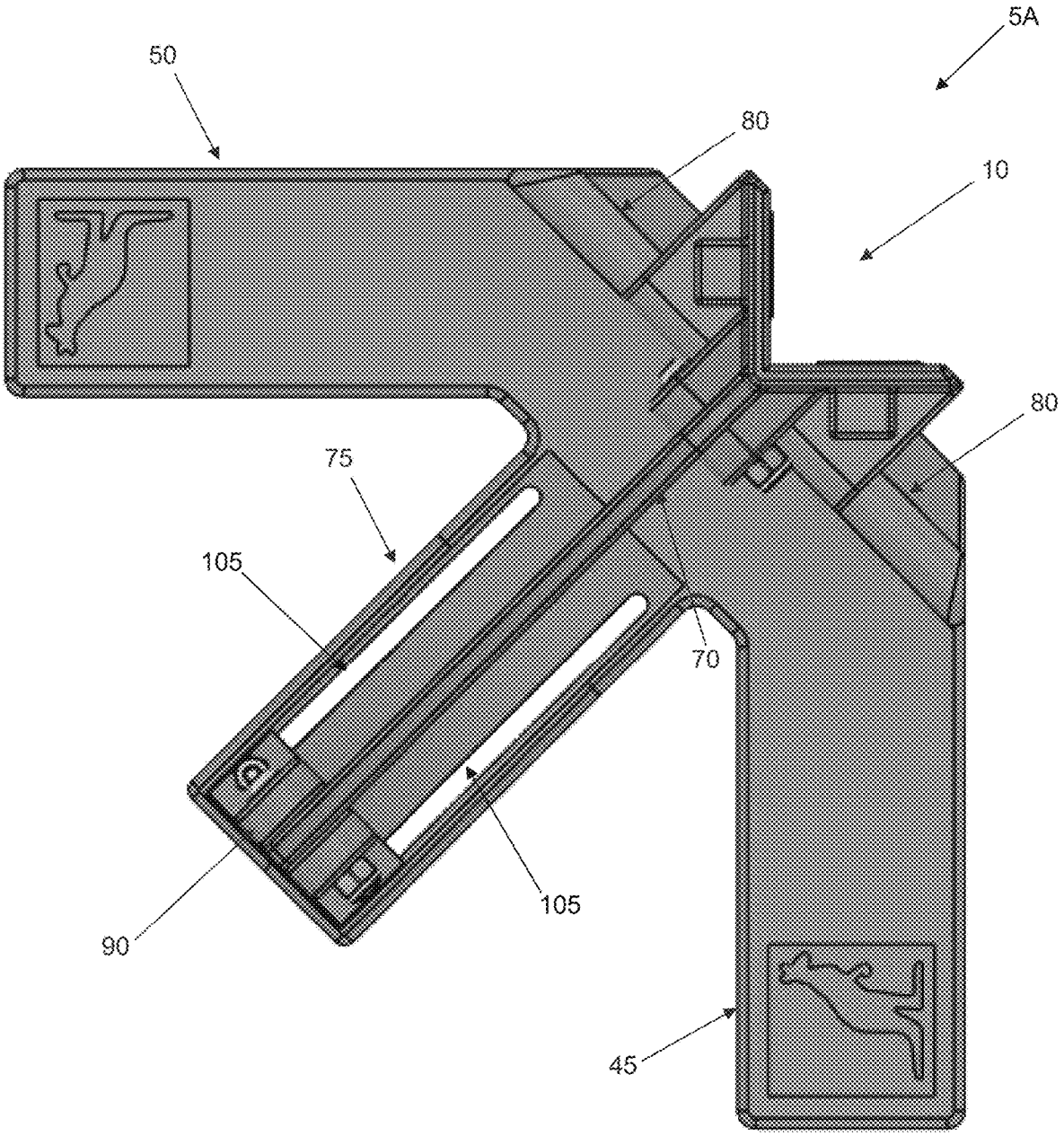
Figure 13:
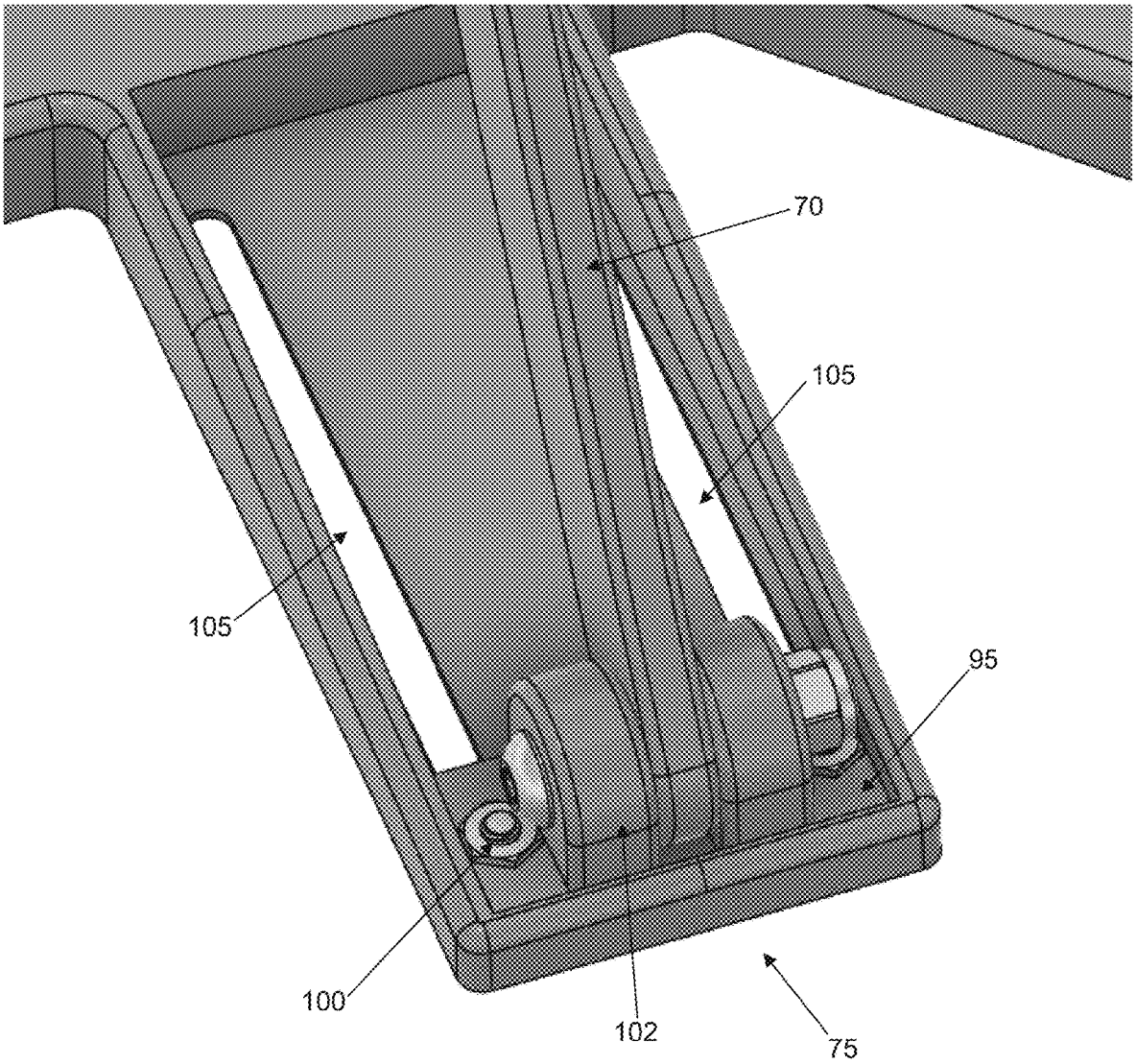

In a preferred embodiment of the invention, stabilization arms 20 are mounted to top portions 35 of vertical portions 25, 30 underneath strap bridges 55. It should be appreciated that the position and thickness of stabilization arms 20 determines how much weight a device 5 can support and how much force can be put against upright portion 10. Thus, stabilization arms 20 may be mounted anywhere along vertical portions 25, 30 and legs 45, 50 and may comprise varying degrees of thickness (i.e., a variable cross-section) along the length of each stabilization arm 20. See FIG. 9, for example, which shows a form of device 5 in which stabilization arms 20 are mounted closer to strap bridges 60 of bottom portions 40 of vertical portions 25, 30 than the form of the device 5 shown in FIG. 1.

Figure 8:
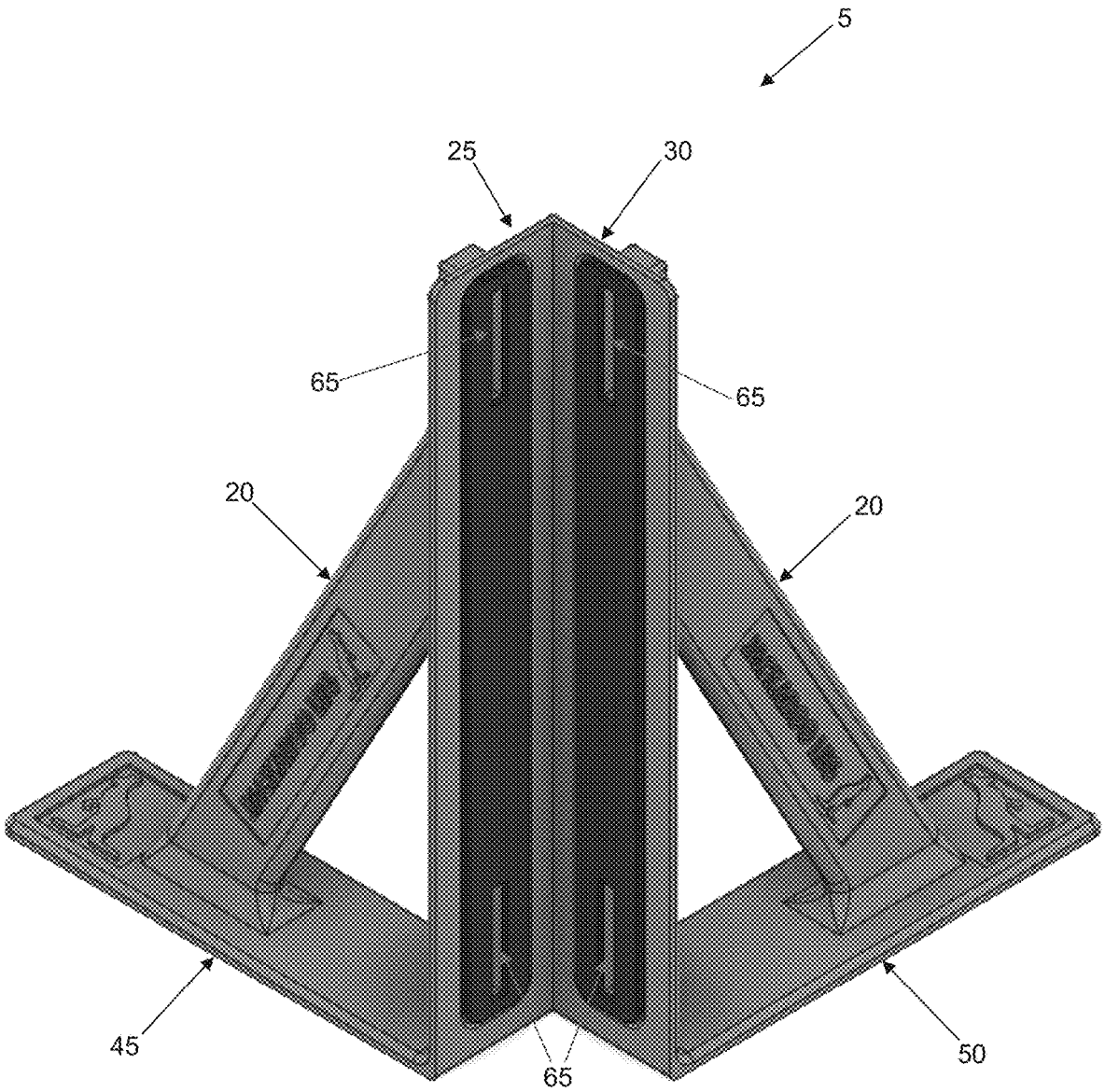
FIGS. 8 and 9 are schematic views showing other forms of the device shown in FIGS. 1-7.

In another form of the invention, and looking now at FIG. 8, top portions 35 and bottom portions 40 of vertical portions 25, 30 may also comprise slots 65. Slots 65 are configured to receive one or more straps 62 (not shown in FIG. 8) for securing device 5 to a leg of an object as will hereinafter be discussed in further detail.

Use of Device 5

Device 5 may be used to prevent an object from falling backwards or to the side. In a preferred embodiment, device 5 may be used to prevent a chair from falling backwards or to the side.

More particularly, in a preferred embodiment of the present invention, device 5 may be attached to a straight back chair leg by placing inner surfaces 32 (or gripping material 36) on to the chair leg. Once inner surfaces 32 (or gripping material 36) are placed on the chair leg, straps 62 are placed through strap bridges 55, 60 and around the chair leg. Straps 62 are then tightened and set so that the device 5 is securely attached to the chair leg. The same procedure may be repeated for the second back chair leg so that each chair has two devices 5 attached (see FIG. 6). The device 5 may be positioned so that one leg 45, 50 is pointing straight back away from the chair (see direction A in FIGS. 6 and 7) and the other leg 45, 50 is pointing directly from the side of the chair (see direction B in FIGS. 6 and 7).

With the device 5 secured to a back chair leg, when a child is on the chair, if the chair begins to tip backwards or sideways, the legs 45, 50 and stabilization arms 20 will absorb and transfer the weight of the child and the chair so that the device 5 stabilizes the chair and prevents the chair from completely falling backwards or sideways. It should be appreciated that the chair may still tip slightly backwards or sideways and/or may move along the floor, but the chair will not fall completely backwards or to the side, thus preventing injury to the child on the chair.

When a device 5 is no longer needed, the device 5 may be removed from a chair leg by simply releasing the straps 62 and removing device 5 from the chair leg.

Note that, in the preferred form of the invention, at no time is device 5 permanently fastened to a leg of an object. However, it should be appreciated that device 5 may be configured to be permanently fastened to a leg of an object, or formed integral with a leg of an object, if desired.

Thus it will be seen that the present invention provides an easy to install device 5 which stabilizes objects having straight legs and prevents objects having straight legs from falling backwards and/or falling sideways.

Flexible Device for Use with Objects Having Various Leg Angles, Shapes and Sizes It should be appreciated that not all objects are built with legs having the same shape/length/size or angle, and thus not all objects are compatible with device 5. Therefore, the present invention also provides for a device that can be adapted to fit a variety of leg angles, sizes, styles, etc. In the foregoing embodiment of the invention, the device is formed as several separate pieces.

In another form of the invention, and looking now at FIGS. 10-13, there is provided a novel device 5A. Device 5A is generally similar to device 5 except that with this form of the invention, the upright portion is hingedly mounted to the base portion and the stabilization arm is hingedly mounted to the upright portion and the base portion.

More particularly, in this form of the invention, device 5A generally comprises upright portion 10 for disposition on a leg of an object, base portion 15 for disposition on a floor and an adjustable stabilization arm 70 hingedly mounted to upright portion 10 and base portion 15.

Base portion 15 comprises first leg 45, second leg 50, a track 75 and mounts 80. Track 75 is positioned in between first leg 45 and second leg 50. Mounts 80 hingedly connect to bottom portions 40 of vertical portions 25, 30 via a rod or pin (not shown). It should be appreciated that, in this form of the invention, legs 45, 50 may be configured to have a greater distance between them which also provides more support and stability to device 5A. It should also be appreciated that the length, width and height of legs 45, 50 can be any length, width or height required for stabilization, however legs 45, 50 must be configured to keep the object stabilized but not so long, wide or thick so as to protrude too far from the object to be stabilized. In one embodiment of the present invention, legs 45, 50 may be thin and flexible. In another embodiment of the present invention, legs 45, 50 may be rigid. Legs 45, 50 may be formed with straight edges or rounded edges.

Adjustable stabilization arm 70 comprises a top portion 85 which is mounted to vertical portions 25, 30 of upright portion 10 via a rod or pin 86, and a bottom sliding portion 90 releasably mounted to track 75. Bottom sliding portion 90 comprises a base 95, at least one fastener 100 for securing base 95 to track 75 and a hinge mount 102 for hingedly securing stabilization arm 70 to base 95 (see FIG. 13). Fastener 100 may comprise a screw, a nut and bolt, etc. It should be appreciated that stabilization arm 70 absorbs the weight of the tipping object and adds stability to device 5A.

Track 75 comprises at least one slot 105 for slidably receiving at least one fastener 100 of base 95. The edges of track 75 may be straight or rounded. It should be appreciated that when the back edge of track 75 is rounded device 5A is able to slide further if an object is tipping very far backwards, thus providing more stability to device 5A. Furthermore, if desired, the edges of legs 45, 50 may also be rounded and/or legs 45, 50 made thin so that legs 45, 50 have additional flexibility and can bend and slide along a floor.

When at least one fastener 100 is loosened, base 95 (and thus adjustable stabilization arm 70) can be slid along slot 105 until the desired angle of upright portion 10 is achieved (as vertical portions 25, 30 will be moved forward or backward as base 95 moves up and down slot 105 in track 75). Once the desired angle of upright portion 10 is reached, fastener 100 is tightened so as to secure base 95 to track 75 and thus set the angle of upright portion 10. In a preferred form of the present invention, device 5 comprises at least two fasteners 100 and at least two slots 105. It should be appreciated that the way in which adjustable stabilization arm 70 is connected to base 95 may comprise any means apparent to one of skill in the art in view of the present disclosure.

Figure 14:
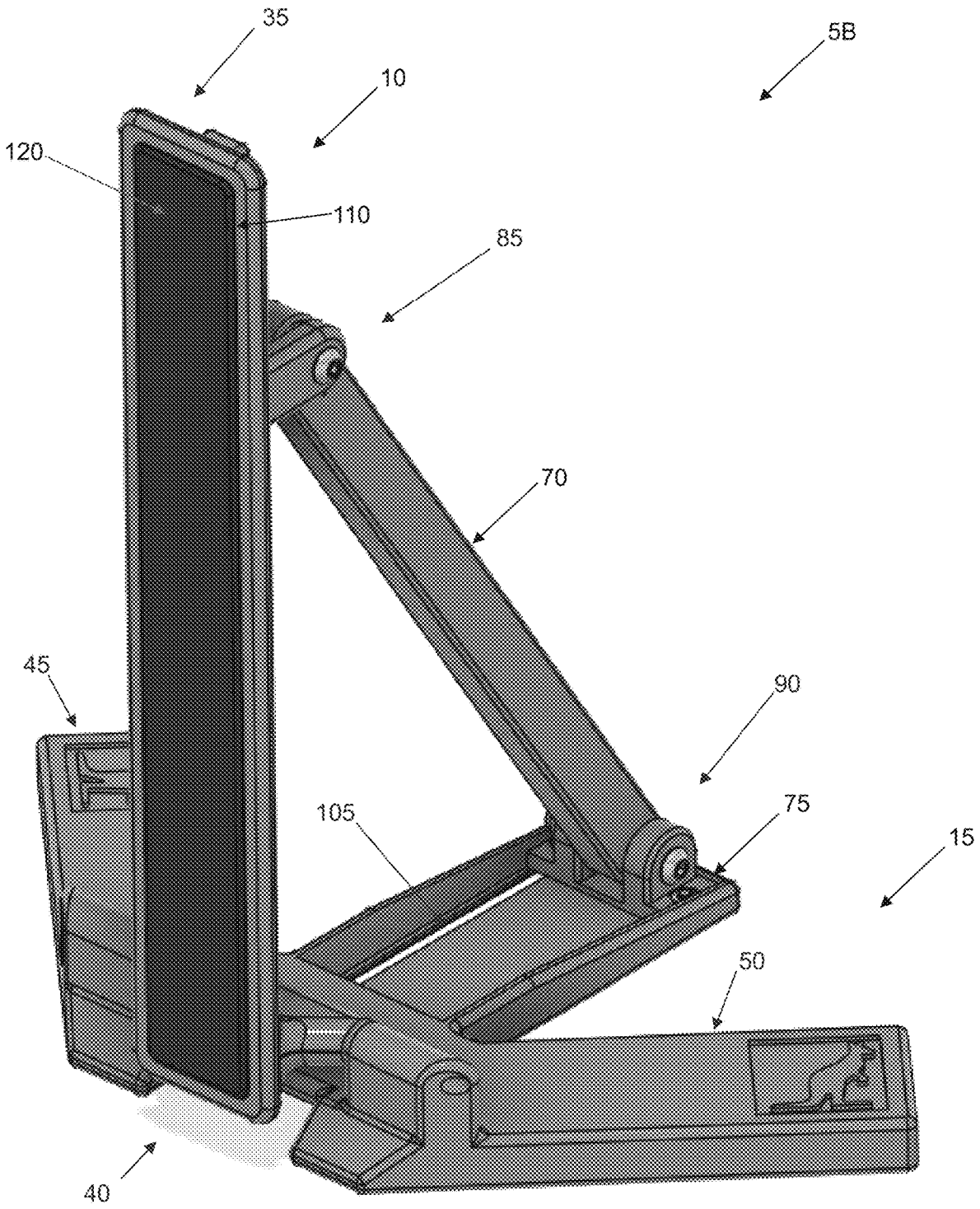
FIGS. 14-16 are schematic views showing another form of the device shown in FIGS. 10-13.
Figure 15:
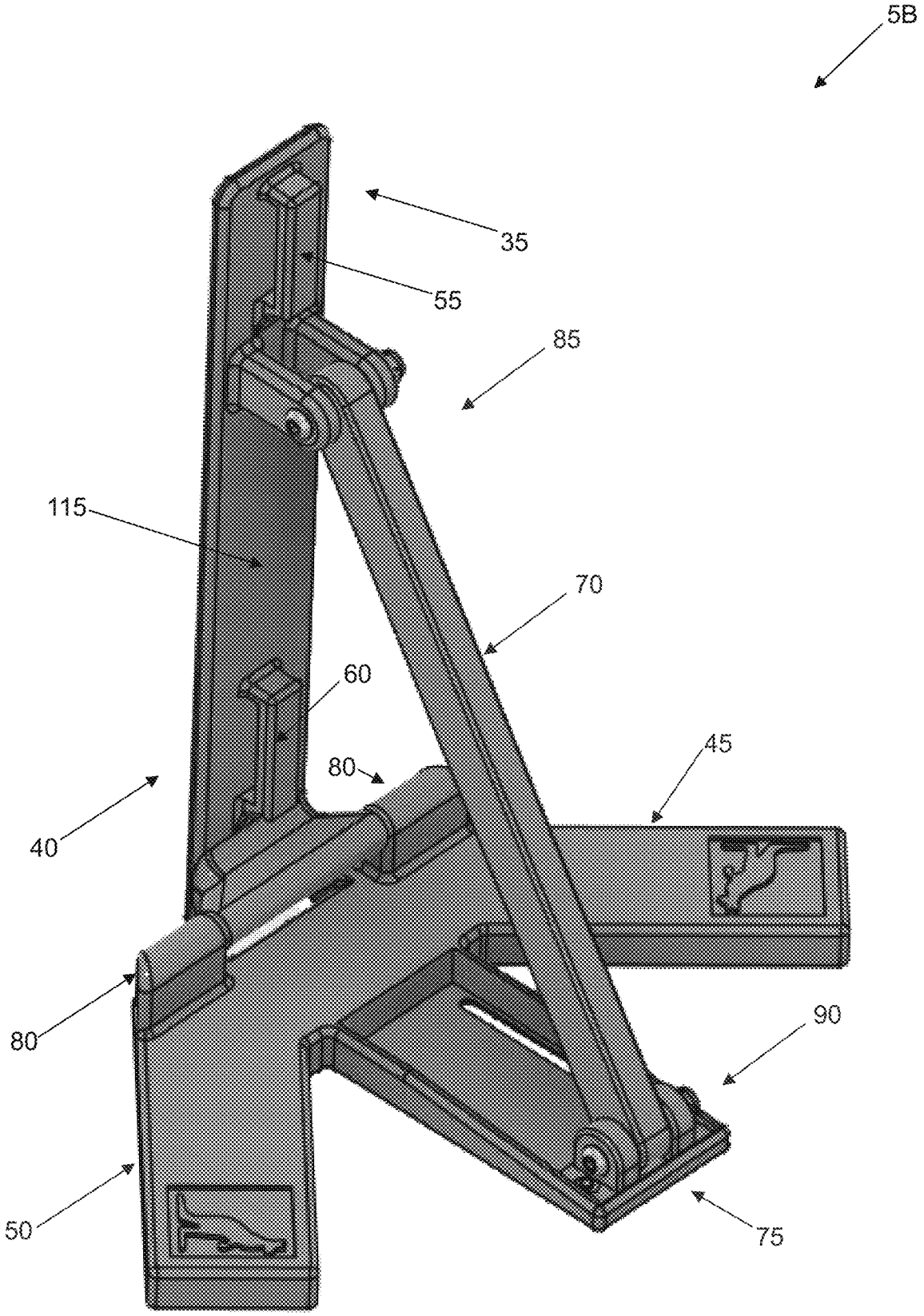
Figure 16:
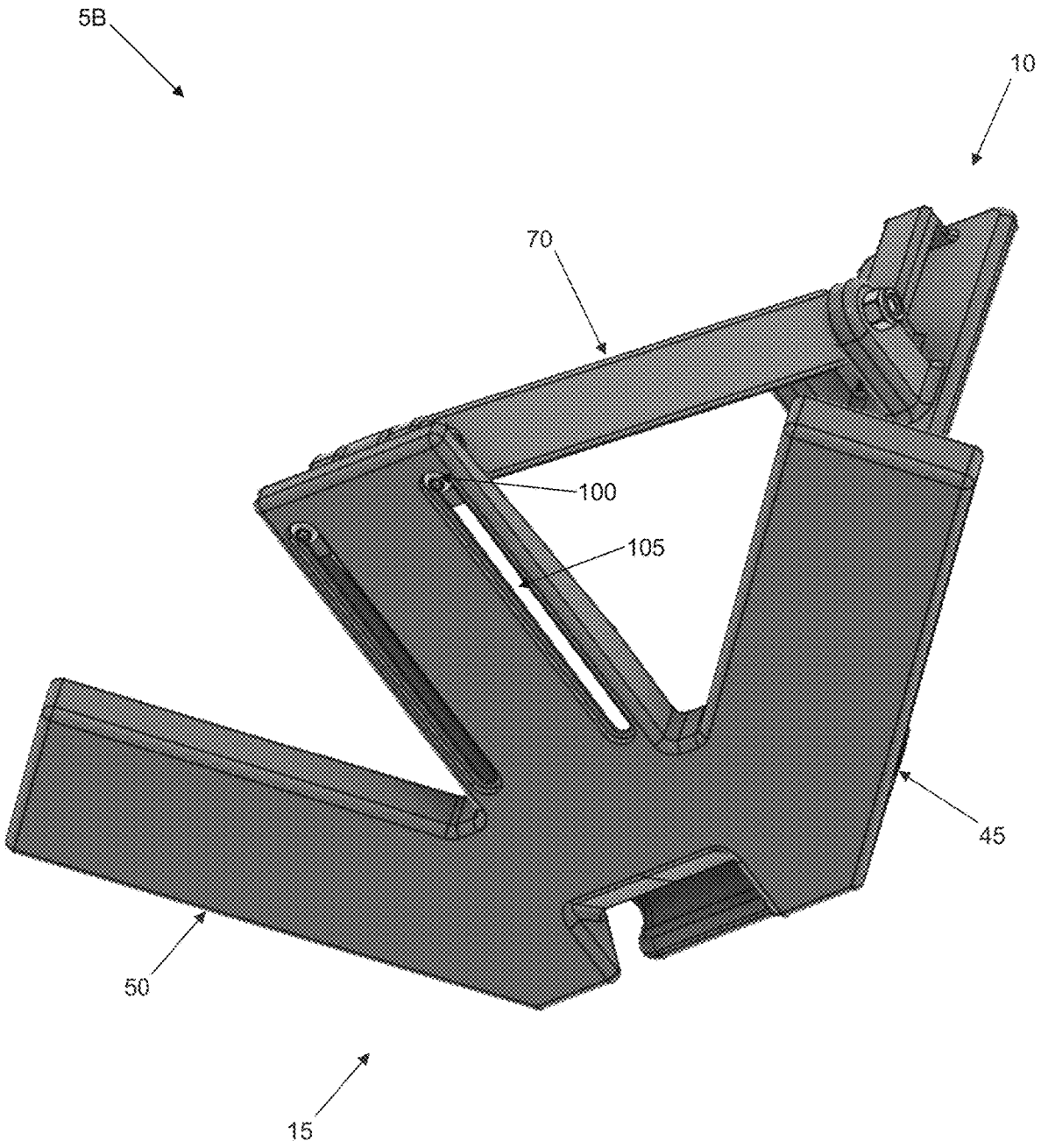
Figure 17:
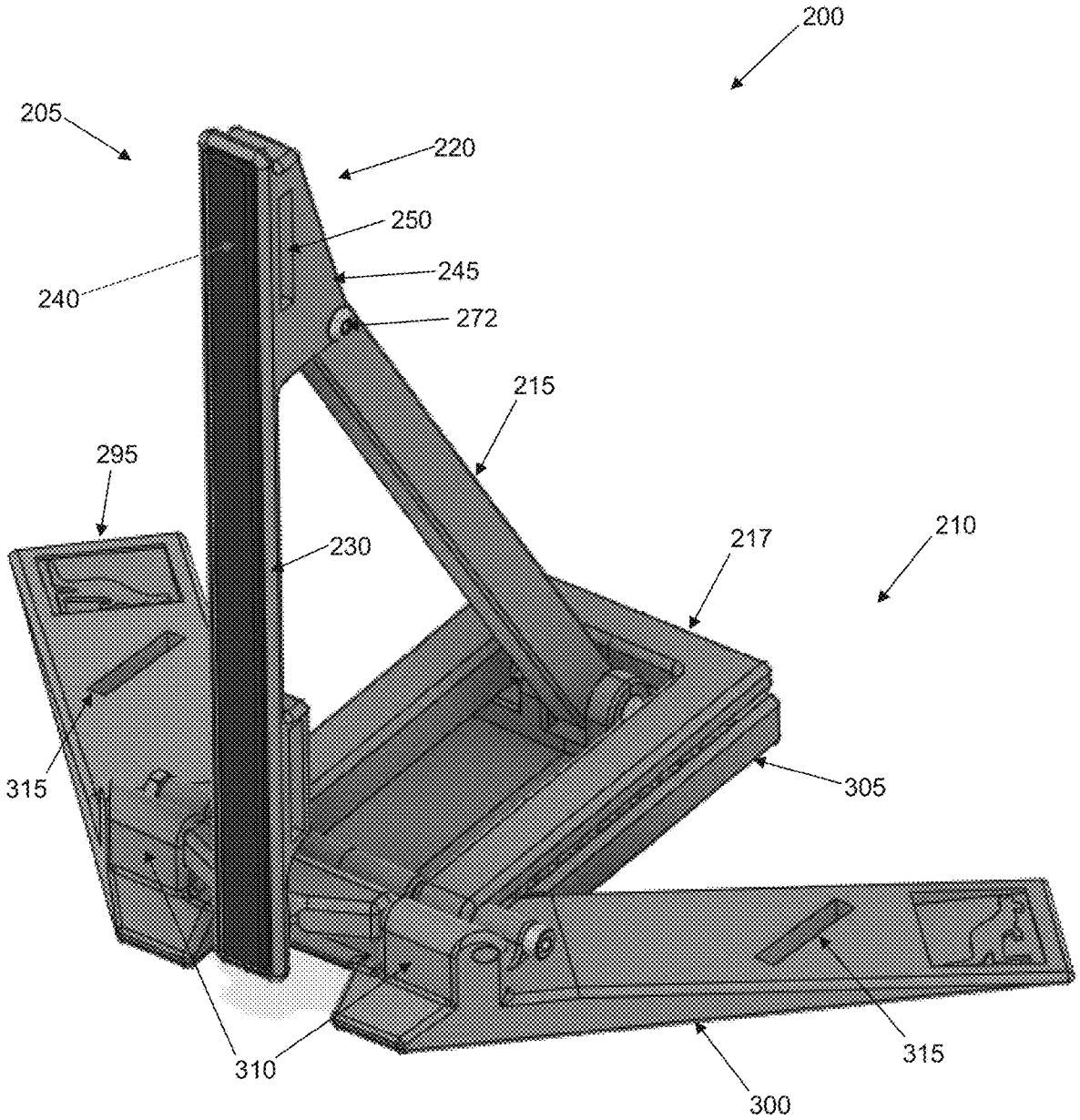
FIGS. 17-22 are schematic views showing another new and improved device for stabilizing an object formed in accordance with the present invention.

In another form of the invention, and looking now at FIGS. 14-16, there is provided a device 5B which allows for additional flexibility of use, as the upright portion 10 is configured to fit a wider variety of legs. Device 5B is generally similar to device 5A except that in this form of the invention, the upright portion is a single component (i.e., there are no longer vertical portions 25, 30). With upright portion 10 formed as a single component, device 5B may be used with legs which could not fit in or be properly secured in the upright portions of devices 5 or 5A.

More particularly, in this form of the invention, upright portion 10 is a single component and has an inner surface 110 for disposition on a leg of an object and an outer surface 115. If desired, inner surface 110 may be provided with a gripping material 120 (e.g., foam pads, tape, double sided Velcro®, furniture pad material, etc.) in order for device 5B to better grip a leg of an object and/or protect a leg of an object from damage due to the attachment (and future removal) of device 5B.

Outer surface 115 of top portion 35 of upright portion 10 comprises a first strap bridge 55, and outer portion 115 of bottom portion 40 comprises a second strap bridge 60. It should be appreciated that upright portion 10 may be provided in different dimensions.

In a preferred form of the present invention, the device may be provided with a lock mechanism for providing easier selection of the angle of the device and a more secure lock on the device to ensure that the angle of the device does not change once weight is pressed against the device (e.g., when an object begins to tilt backwards) while still allowing for the flexibility of the device to be used on various leg angles, shapes, sizes, etc.

More particularly, and looking now at FIGS. 17-28, there is provided another novel device 200 formed in accordance with the present invention. Device 200 is generally similar to device 5B, however, device 200 comprises additional features for improving the stability and endurance of the device. Device 200 generally comprises an upright portion 205 for disposition on a leg of an object, a base portion 210 for disposition on a floor, an adjustable stabilization arm 215 and a lock mechanism 217.

Upright portion 205 comprises a top portion 220 and a bottom portion 225, an inner surface 230 for disposition on a leg of an object and an outer surface 235. If desired, inner surface 230 may be provided with a gripping material 240 (e.g., foam pads, tape, double sided Velcro®, furniture pad material, etc.) in order for the device 200 to better grip a leg of an object and/or protect a leg of an object from damage due to the attachment (and future removal) of a device 200. It should be appreciated that the dimensions of upright portion 205 may be varied as needed.

Figure 18:
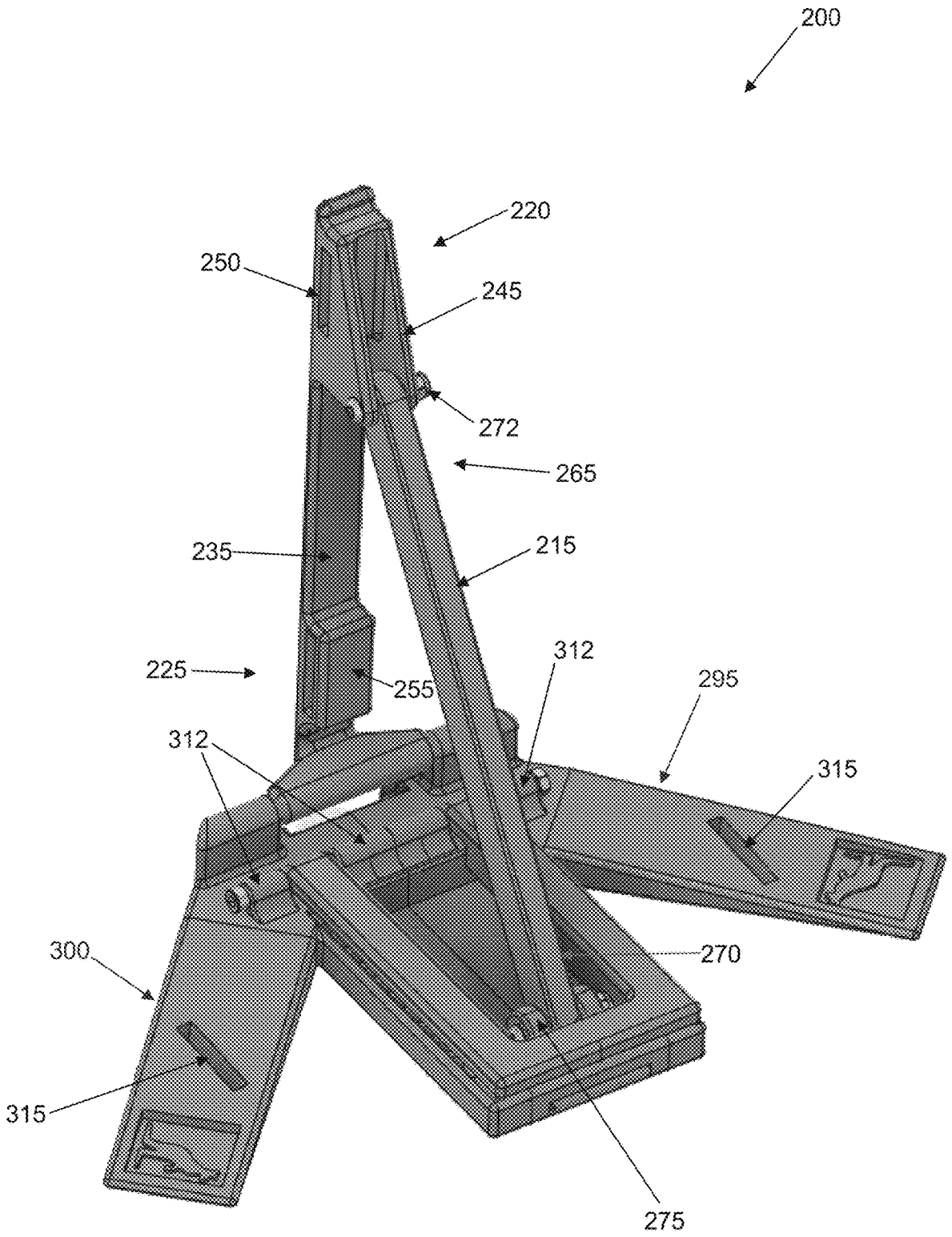
Figure 19:
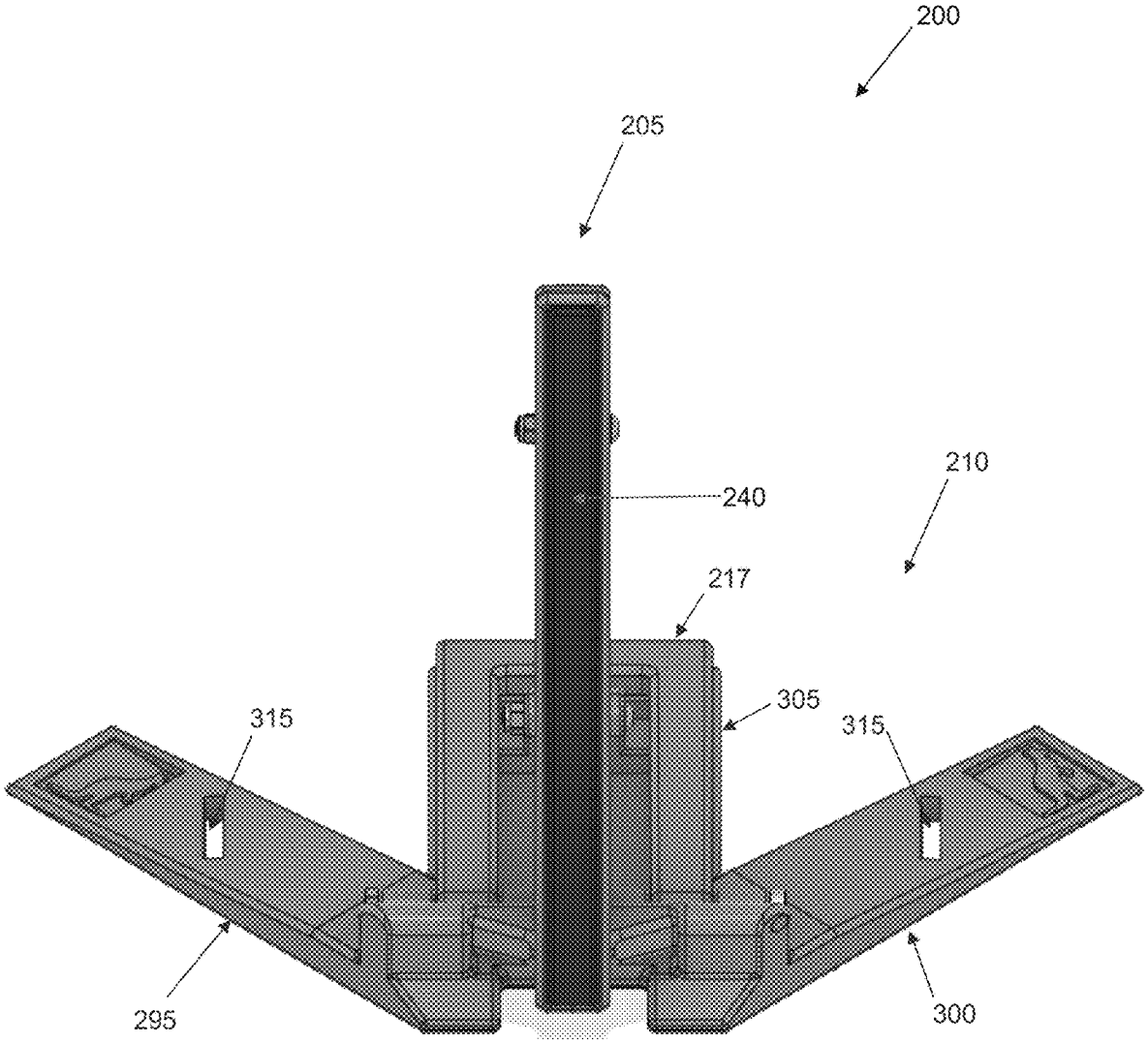
Figure 20:
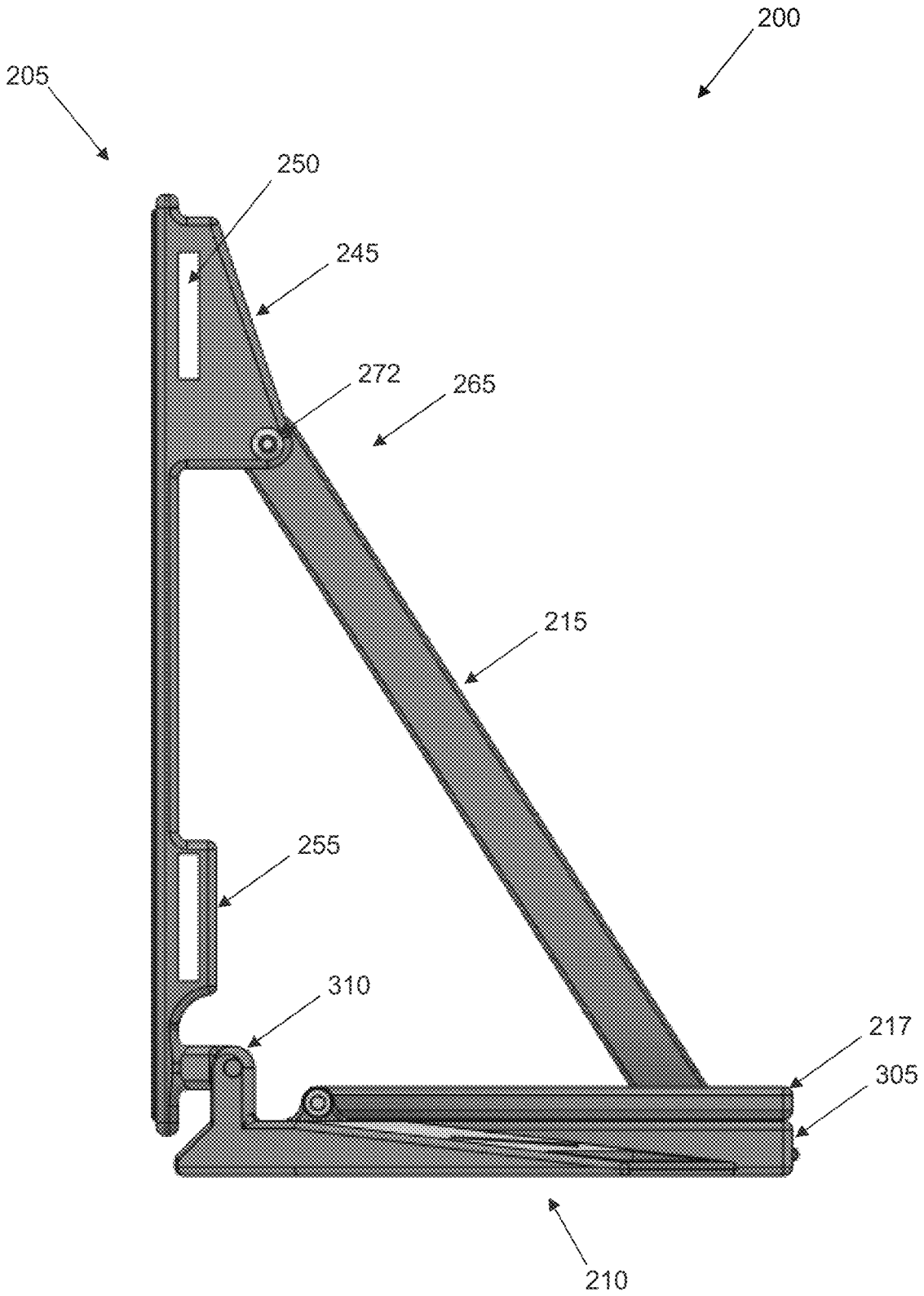
Figure 21:
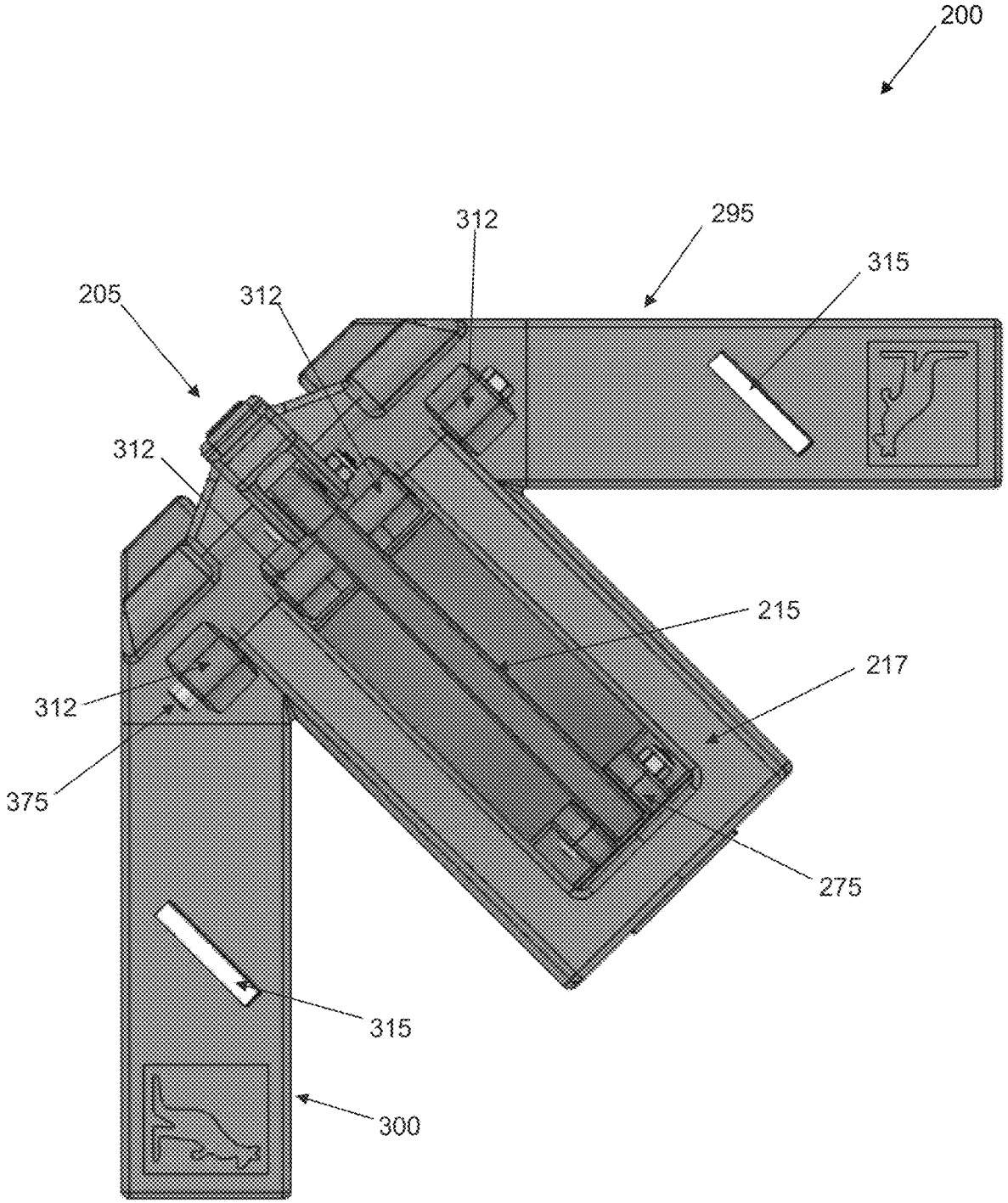
Figure 22:
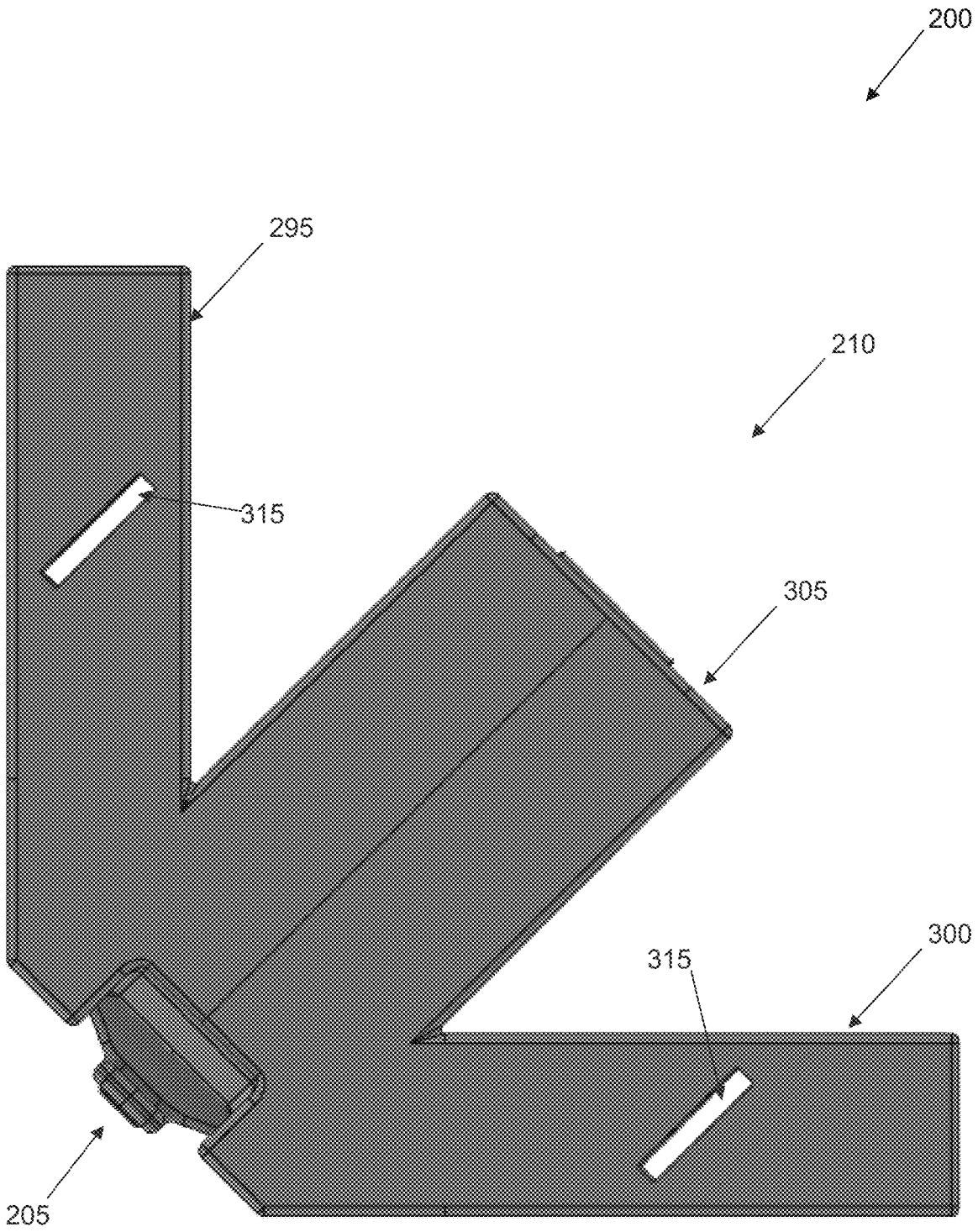

Top portion 220 of upright portion 205 comprises a housing 245 having a slot 250 passing therethrough (see FIG. 18). Bottom portion 225 of upright portion 205 comprises a strap bridge 255 and is hingedly mounted to base portion 210 via a rod or pin (not shown). Slot 250 and strap bridge 255 are configured so that a first strap 260 (e.g., Velcro®, cable ties, etc.) can be slid through slot 250 and a second strap 260 can be slid through strap bridge 255, around a leg of an object (and, if desired, possibly through the slot and strap bridge a second time, depending on the length of the straps) and tightly fastened so as to secure the device 200 to a leg of an object (see FIG. 28 which shows device 200 secured to the leg of a chair).

Adjustable stabilization arm 215 comprises a first end 265 and a second end 270. First end 265 is hingedly mounted to housing 245 of upright portion 205 via a pin or rod 272. Second end 270 comprises a mount 275. Mount 275 is hingedly connected to second end 270 via a pin or rod 280 and comprises a plurality of teeth 285 and a plurality of ridges 290 (see FIG. 26).

Base portion 210 comprises a first leg 295, a second leg 300, a track 305 positioned in between first leg 295 and second leg 300, mounts 310 and a plurality of raised tunnels 312. First leg 295 and second leg 300 may comprise slots 315 for receiving a strap 320 (see FIG. 28). Legs 295, 300 may be ramped so that the thickest portion of legs 295, 300 are connected to base portion 210. Mounts 310 hingedly connect to bottom portion 225 of upright portion 205 via a rod or pin (not shown). It should be appreciated that the length, width and height of legs 295, 300 may be any length, width or height required for stabilization, however legs 295, 300 must be configured to keep an object stable during tipping, but not so long, wide or thick so as to protrude too far from the object to be stabilized. In one embodiment of the present invention, legs 295, 300 may be thin and flexible. In another embodiment of the present invention, legs 295, 300 may be rigid. Legs 295, 300 may be formed with straight edges or rounded edges.

It should be appreciated that, if desired, base portion 210 may comprise a single leg or more than two legs. Furthermore, base portion 210 may comprise straight edges or rounded edges. If desired, base portion 210 may comprise a material (not shown) for contacting the floor (e.g., furniture pad material, felt, etc.).

Figure 24:
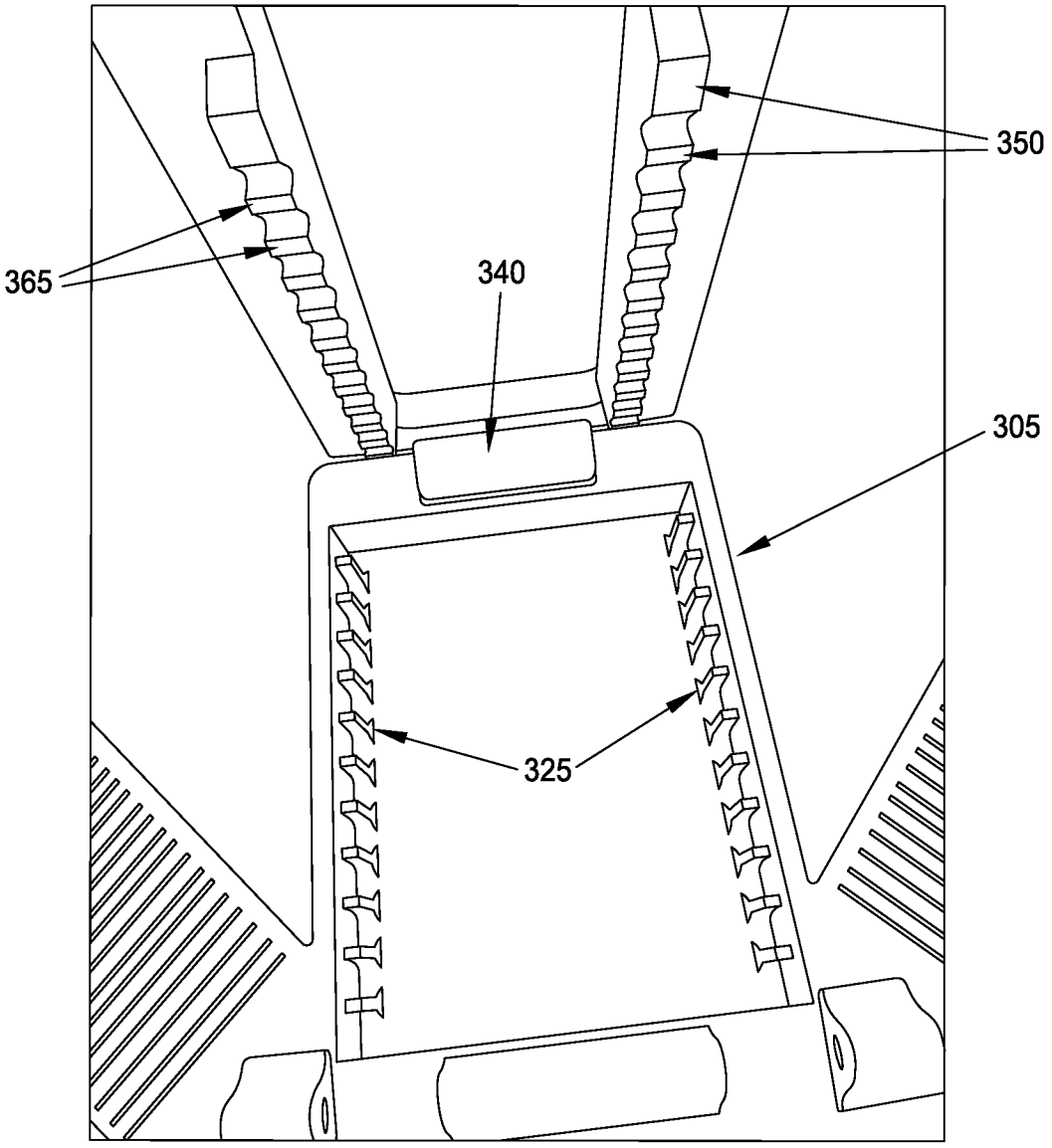
Figure 25:
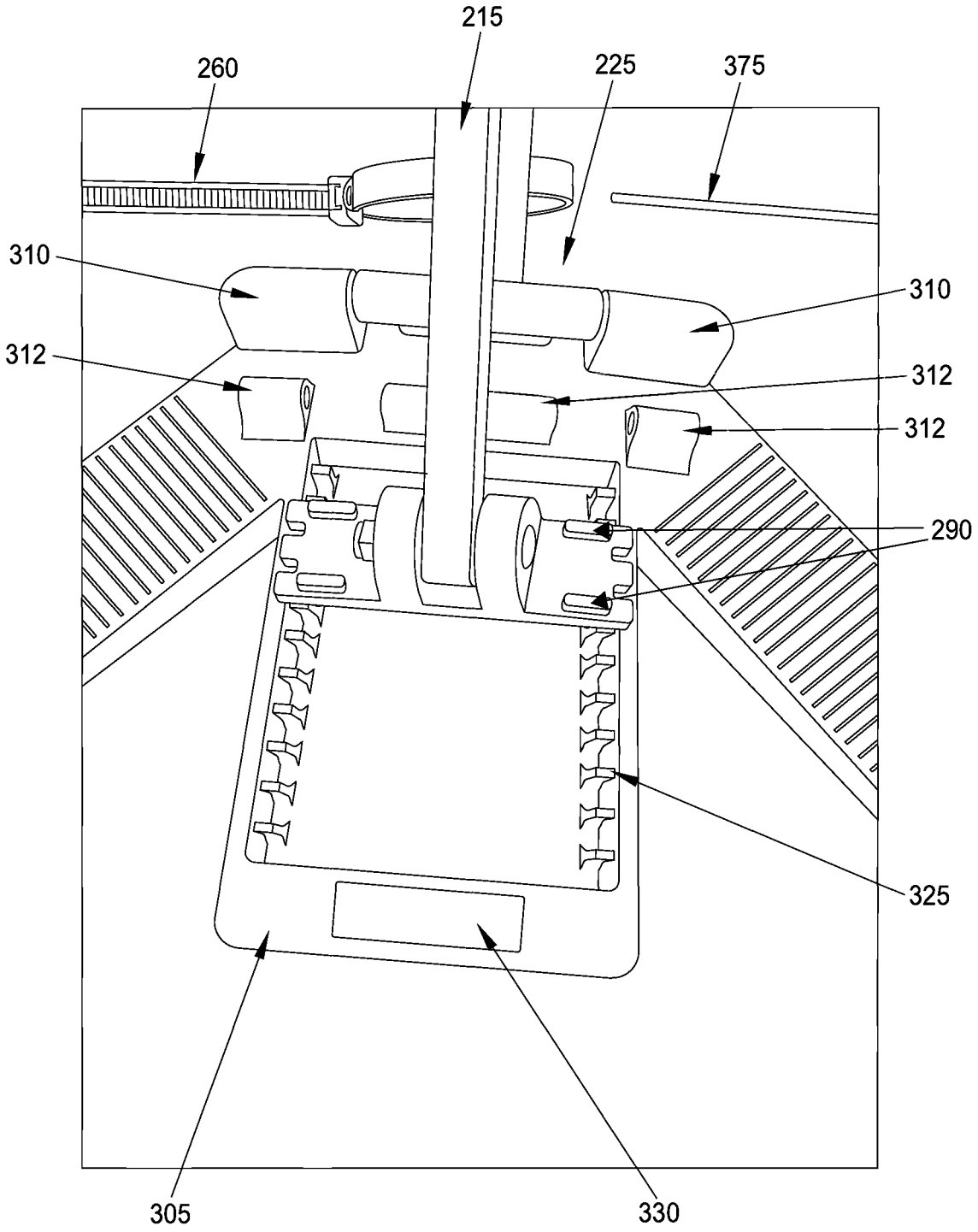
Figure 26:
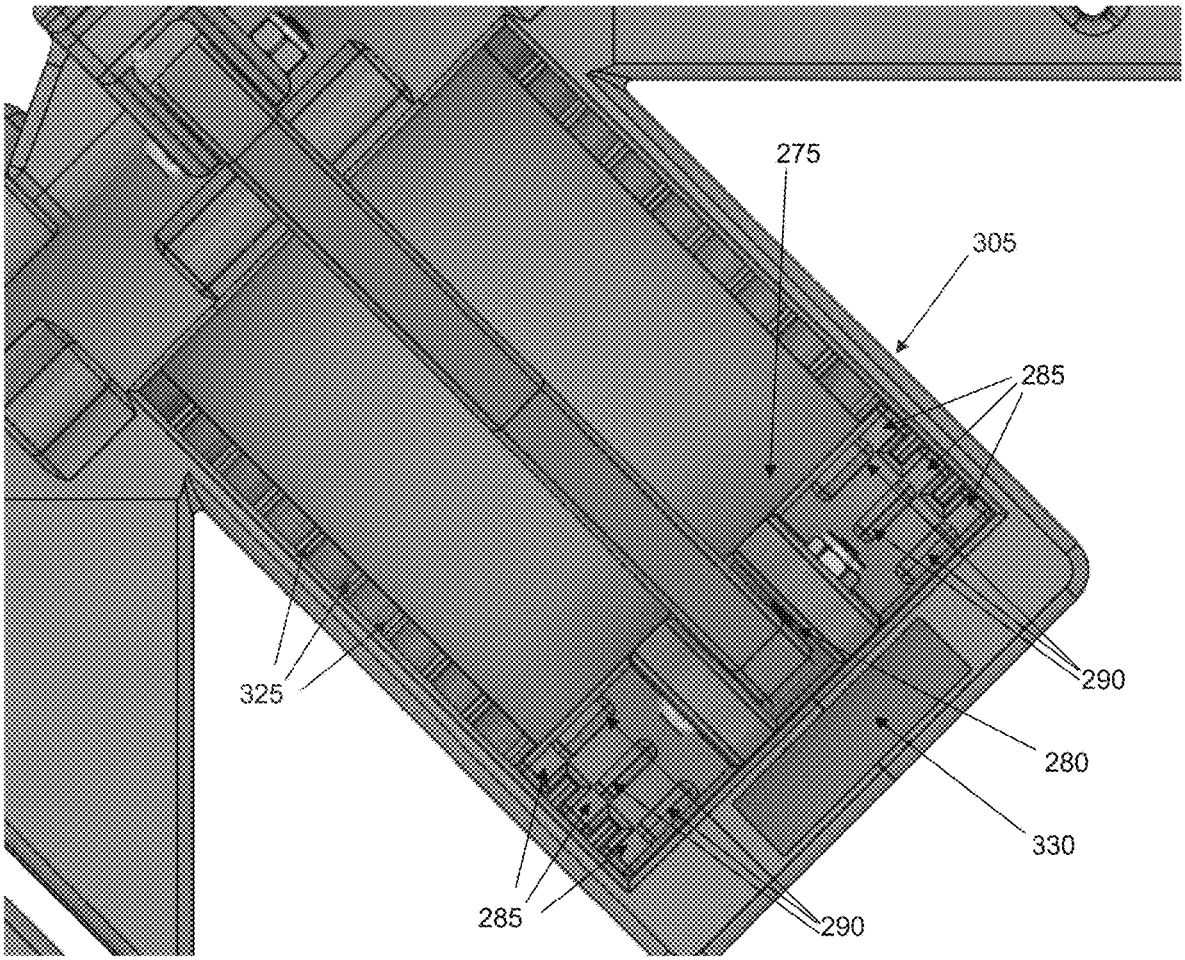
Figure 27:
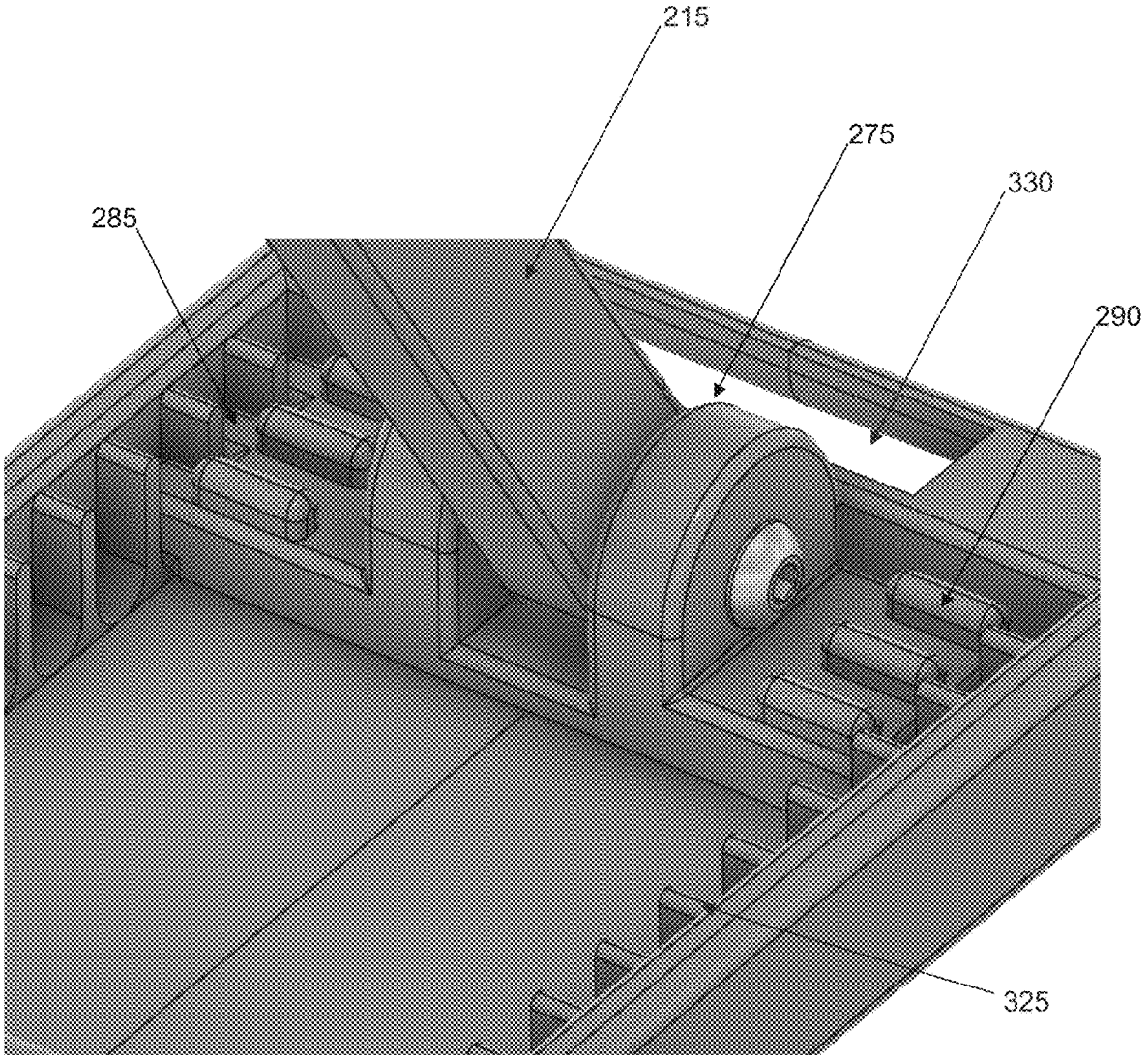
Figure 28:
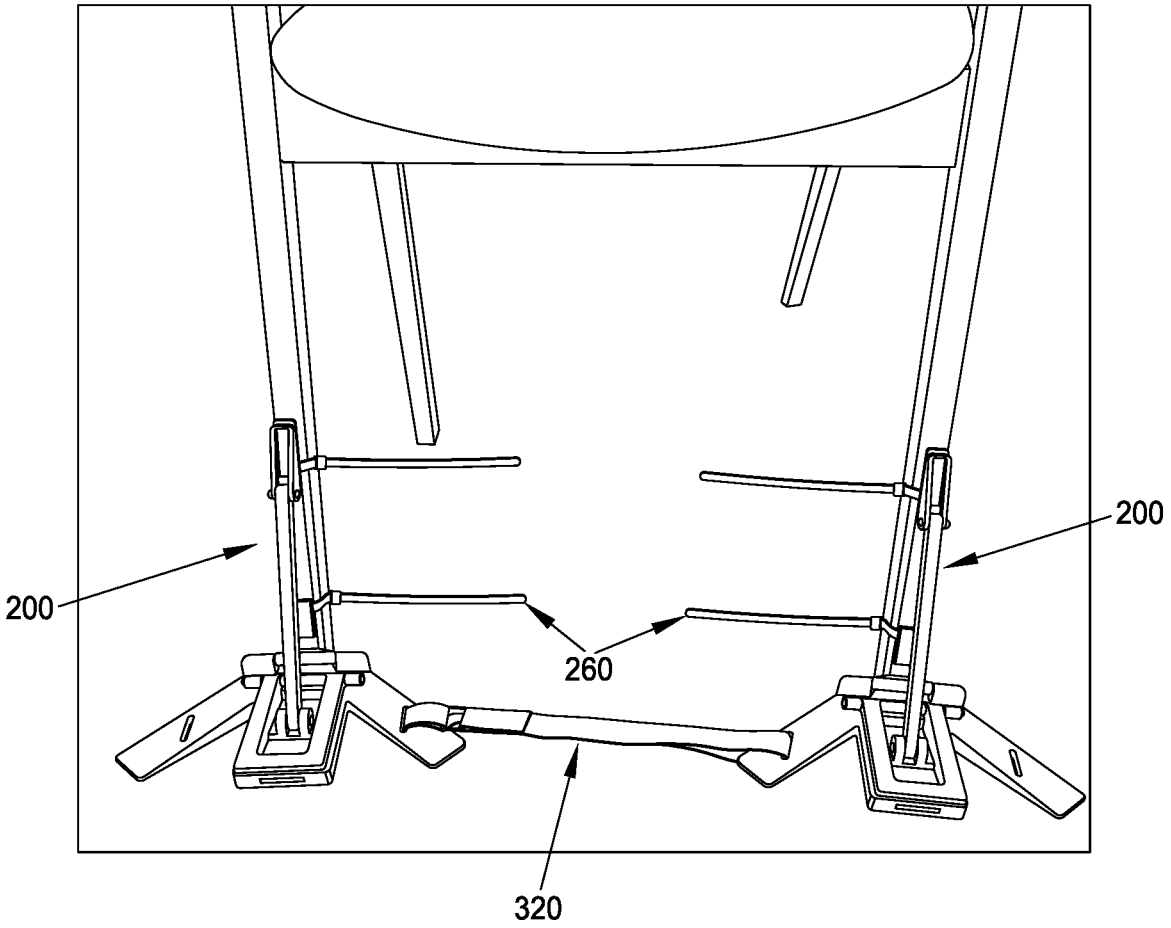
FIG. 28 is a schematic view showing the device of FIGS. 17-27 in use on a chair.
Figure 28A:
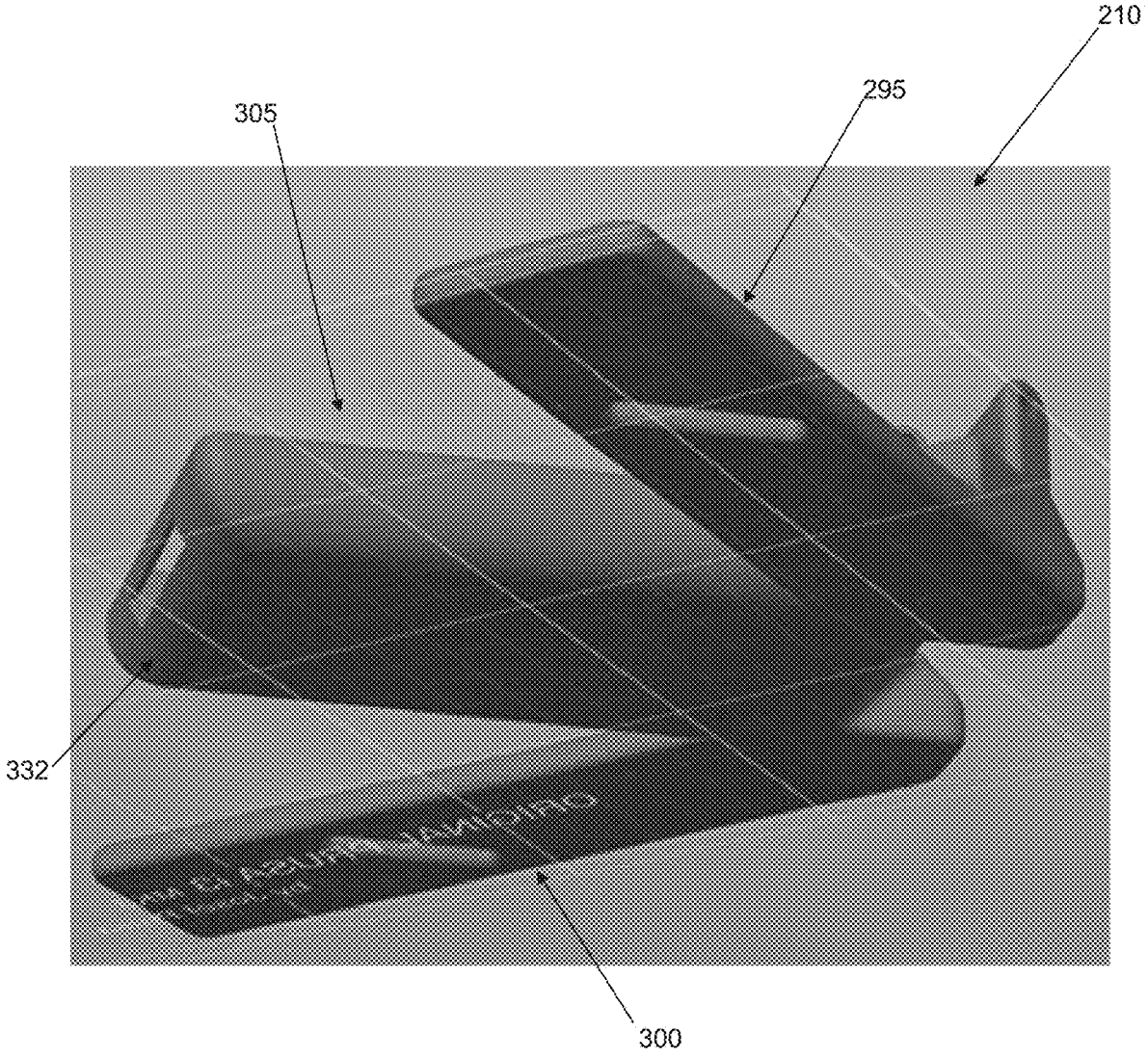
FIGS. 28A-28C are schematic views showing one embodiment of the base portion of the device of FIGS. 17-22 in further detail.
Figure 28B:
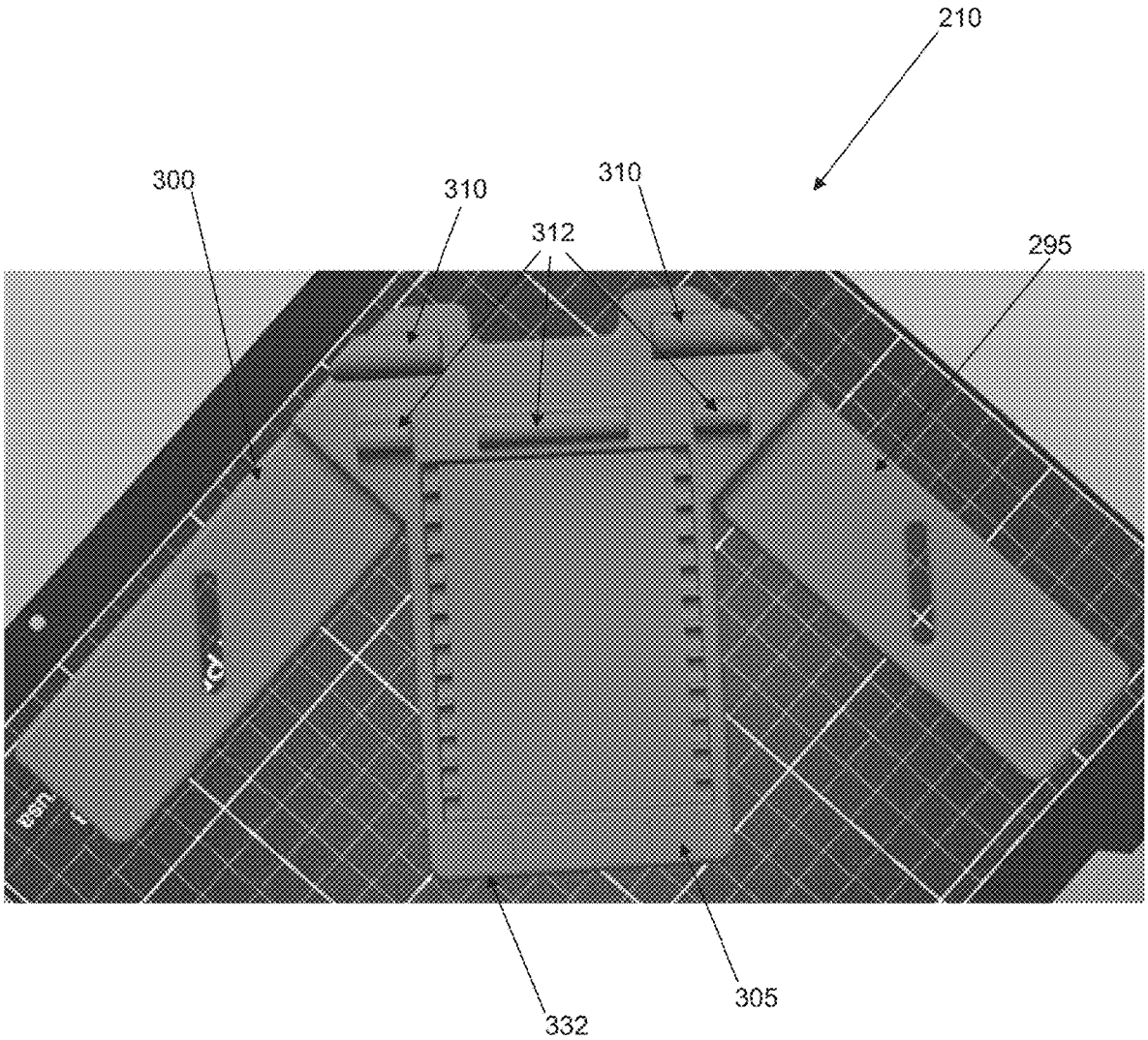
Figure 28C:
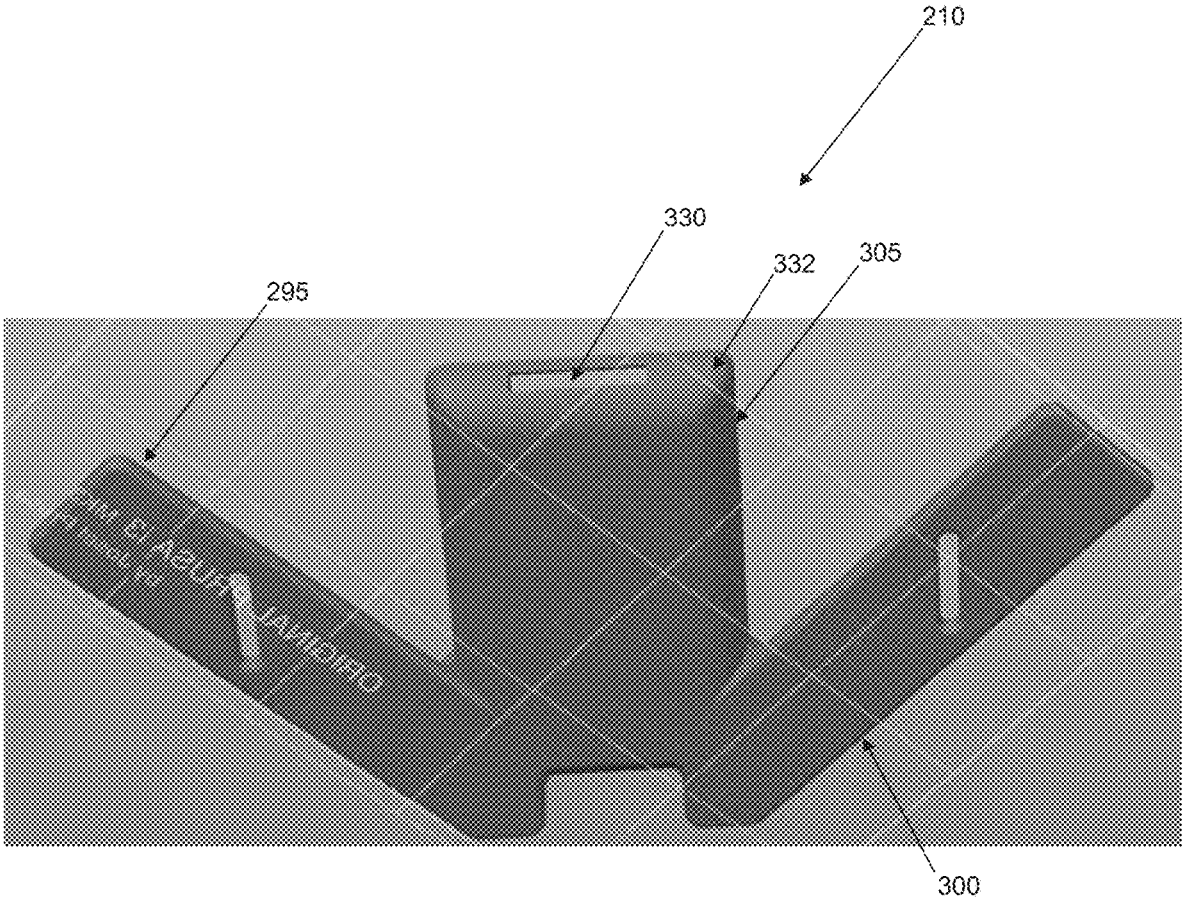

Track 305 comprises a plurality of ribbed racks 325 along its sides and an opening 330 (see FIGS. 24-26). Ribbed racks 325 are configured to engage teeth 285 of mount 275 of stabilization arm 215. The edges of track 305 may be straight or rounded. It should be appreciated that when the back edge 332 of track 305 is rounded (see FIGS. 28A-28C) device 200 is able to slide further if an object is tipping very far backwards, thus providing more stability to device 200. Furthermore, if desired, the edges of legs 295, 300 may also be rounded and/or legs 295, 300 made thin so that legs 295, 300 have additional flexibility and can bend and slide along a floor.

Figure 23:
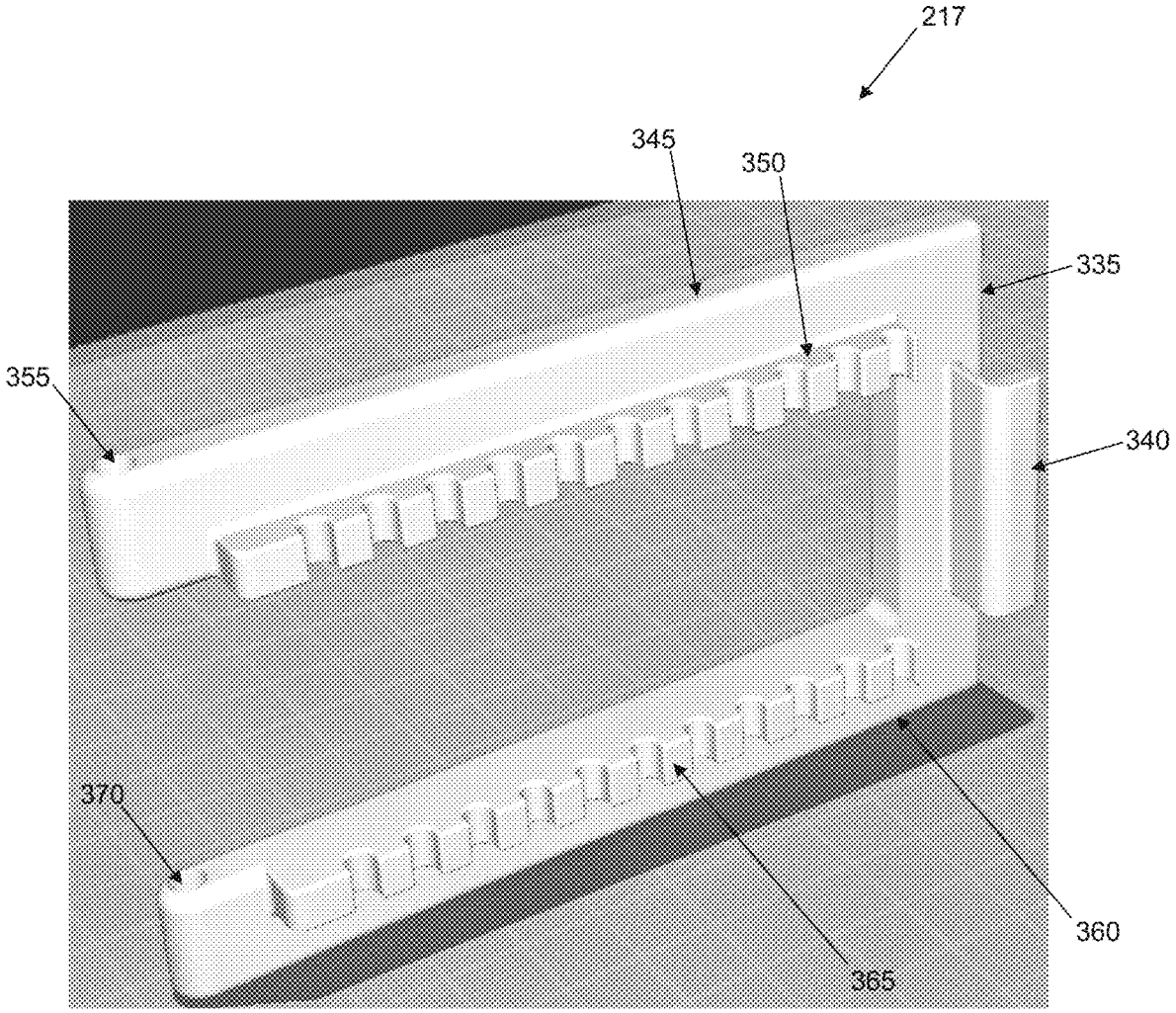
FIGS. 23-27 are schematic views showing the lock mechanism of the device of FIGS. 17-22 in further detail.

Lock mechanism 217 comprises a first portion 335 having a hook 340, a second portion 345 having a ribbed rack 350 and a through hole 355, and a third portion 360 having a ribbed rack 365 and a through hole 370 (see FIG. 23). Hook 340 is configured to hingedly mount in opening 330 of track 305. Ribbed racks 350, 365 are configured to engage the plurality of ridges 290 on mount 275 of stabilization arm 215. Through holes 355, 370 are configured to receive a fastener 375 for securing lock mechanism 217 to track 305 via raised tunnels 312 of base portion 210. Fastener 375 may comprise a nut and bolt or any other fastening means known in the art.

Thus it will be appreciated that when fastener 375 is not passed through raised tunnels 312 and through holes 355, 370 so as to secure lock mechanism 217 to track 305, lock mechanism 217 may be opened (via moving hook 340 in opening 330) and mount 275 may be moved to a desired location in track 305.

It should be appreciated that lock mechanism 217 is provided to selectively lock stabilization arm 215 in place, and thereby lock upright portion 205 at a desired angle. More particularly, lock mechanism 217 is provided to selectively lock mount 275 of stabilization arm 215 in an "engaged" position (and hence prevent stabilization arm 215 from movement) wherein (i) teeth 285 of mount 275 engage ribbed racks 325 of track 305, (ii) lock mechanism 217 is closed so that ridges 290 of mount 275 engage ribbed racks 350, 365 of lock mechanism 217, and (iii) fastener 375 is placed through through holes 355, 370 of lock mechanism 217 and raised tunnels 312 of base portion 210. When lock mechanism 217 is in a "disengaged" position (and hence stabilization arm 215 is free to move and thus adjust the angle of upright portion 205) (i) fastener 375 is removed from through holes 355, 370 of lock mechanism 217 and raised tunnels 312 of base portion 210, (ii) lock mechanism 217 is opened so that ridges 290 of mount 275 of stabilization arm 215 are disengaged from ribbed racks 350, 365 of lock mechanism 217, and (iii) teeth 285 of mount 275 are disengaged from ribbed racks 325 of track 305.

It should also be appreciated that with device 200 the stress from the tipping object is absorbed by top portion 220 of upright portion 205 and transfers down stabilization arm 215 and into track 305 of base portion 210 to the ground.

Figure 29:
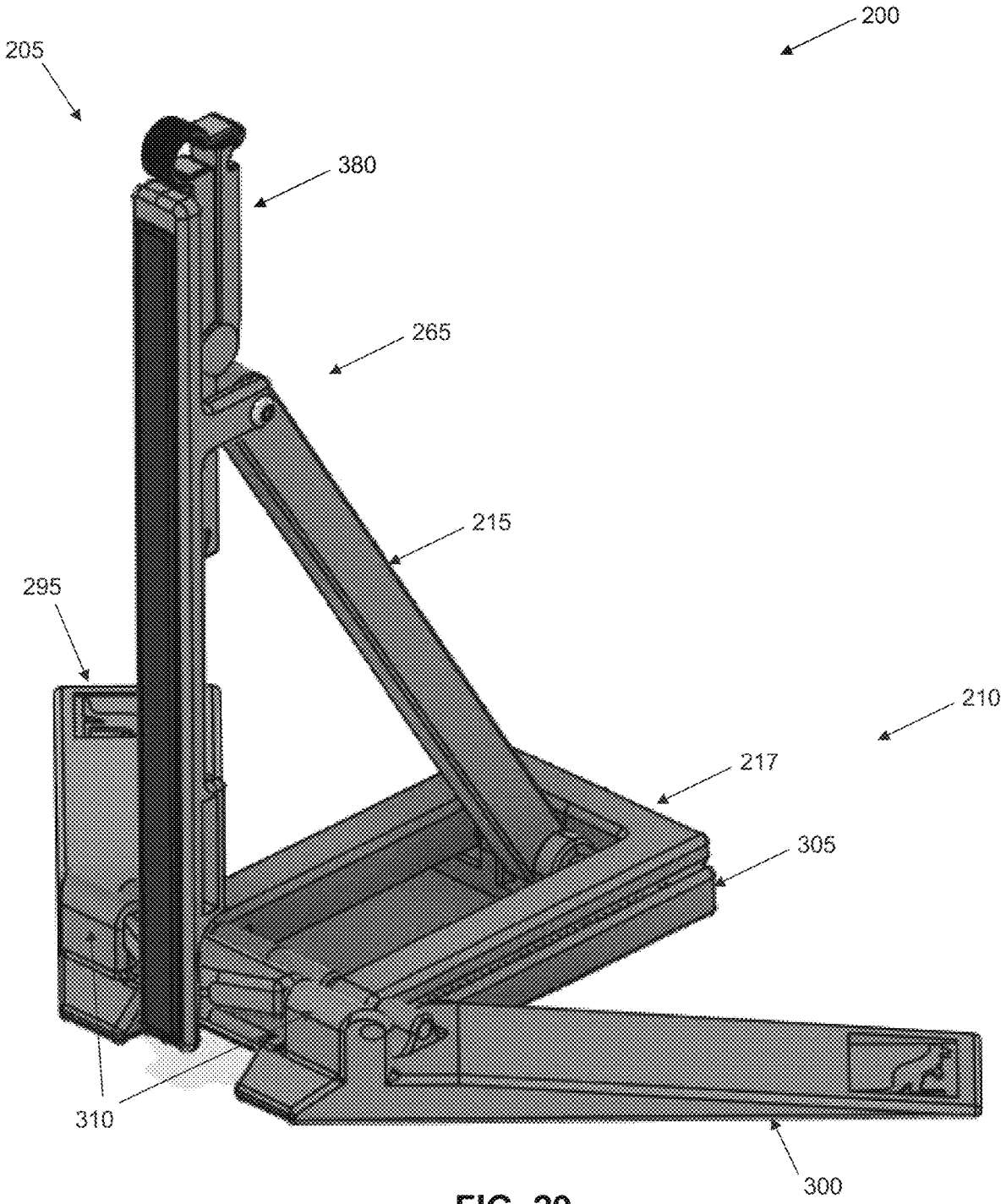
FIGS. 29 and 30 are schematic views showing a clip which may be added at the top of the device shown in FIGS. 17-27.
Figure 30:
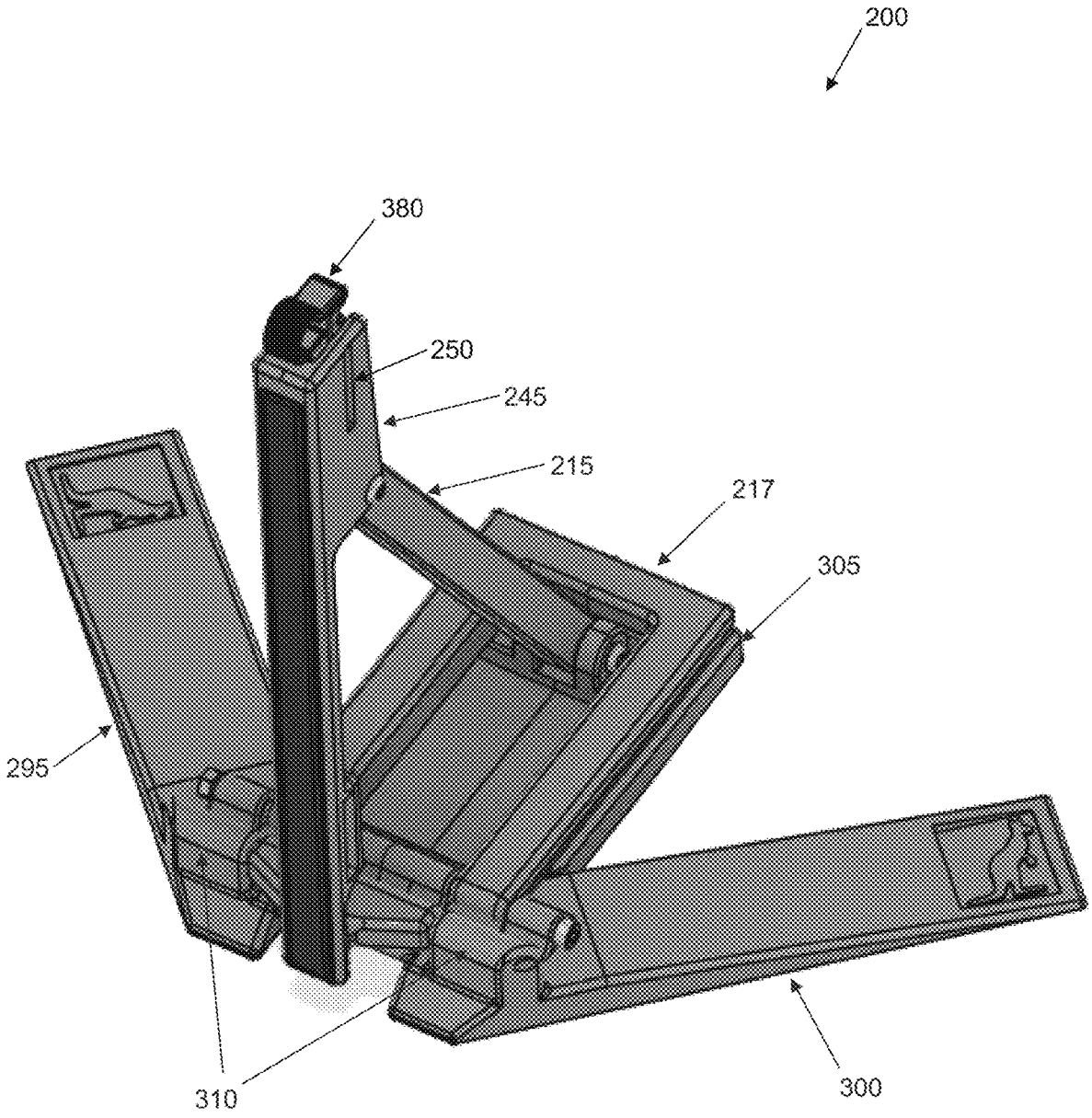

If desired, and looking now at FIGS. 29 and 30, a clip 380 may be provided in order to provide additional securement of a strap 260 to top portion 220 of upright portion 205. Clip 380 may be formed in housing 245 of top portion 220 of upright portion 205 or be provided separately. Clip 380 may be configured to receive a strap 260 (e.g., Velcro®, cable ties, etc.) (not shown in FIGS. 29 and 30) via slot 250 of housing 245.

Furthermore, it should be appreciated that the aforementioned lock mechanism or such other lock mechanisms which will be apparent to one of skill in the art in view of the present disclosure may be used with the present invention.

Use of Device 200

Device 200 may be used to prevent an object from falling backwards or to the side. In a preferred embodiment, device 200 may be used to prevent a chair from falling backwards or to the side.

More particularly, in a preferred embodiment of the present invention, device 200 can be attached to a back chair leg by adjusting the angle of upright portion 205 via stabilization arm 215 to fit the angle of the chair leg.

In order for stabilization arm 215 to be able to move, lock mechanism 217 must be in its "disengaged" position. In order to disengage lock mechanism 217, fastener 375 is removed from through holes 355, 370 and raised tunnels 312 whereby to allow lock mechanism 217 to open (thus removing teeth 285 from ribbed racks 325 of track 305 and removing ridges 290 from ribbed racks 350, 360). Mount 275 of stabilization arm 215 may then be removed from ribbed racks 325 of track 305 and placed along the ribbed racks 325 in the desired position to achieve the desired angle of upright portion 205 which matches the angle of the chair leg. Once mount 275 is placed back into position (i.e., so that teeth 285 are engaged in ribbed racks 325), lock mechanism 217 may be closed so that ribbed racks 350, 360 seat over ridges 290 of mount 275. Fastener 375 is then placed back through through holes 355, 370 and raised tunnels 312. When fastener 375 is locked in place (e.g., with a nut), lock mechanism 217 is in the "engaged" position and thus stabilization arm 215 (and hence upright portion 205) is held in place.

Once the correct angle of upright portion 205 is achieved and stabilization arm 215 is locked in place, inner surface 230 (or gripping material 240) of upright portion 205 is placed on to the chair leg. Once inner surface 230 (or gripping material 240) is placed on the chair leg, a first strap 260 is placed through slot 250 of housing 245 of upright portion 205 and around the chair leg, and a second strap 260 is placed through strap bridge 255 of bottom portion 225 of upright portion 205 and around the chair leg. Straps 260 are then tightened and set so that the device 200 is securely attached to the chair leg. If needed, the angle of the device 200 can be further adjusted after securement to a chair leg. The same procedure may be repeated for the second back chair leg so that each chair has two devices 200 (see FIG. 28). The device 200 should be positioned so that track 305 sits directly behind the chair leg (see FIG. 28).

It should be appreciated that in some cases, devices 200 can shift to the side during use, but having strap 320 placed between two devices 200 further stabilizes the devices 200 and holds the devices 200 straight (i.e., so that track 305 remains directly behind a chair leg). Thus, if desired, optional strap 320 may be placed through a slot 315 in one of each of leg 295, 300 so that strap 320 connects two devices 200 together, further stabilizing the devices on the chair legs (see FIG. 28) or any other object with legs.

When it is desired to remove device 200 from an object to which it is mounted, straps 260 are simply released and device 200 removed from the object.

Note that, in the preferred form of the invention, at no time is device 200 permanently fastened to a leg of an object. However, it should be appreciated that device 200 may be configured to be permanently fastened to a leg of an object, or formed integral with a leg of an object, if desired.

Thus it will be seen that the present invention provides an easy to install device 200 which stabilizes objects having legs of various angles, shapes, sizes, etc.

Alternative Embodiments of the Device

It should be appreciated that different means for allowing stabilization arm 215 to move in track 305 may be utilized in accordance with the present invention.

Figure 31:
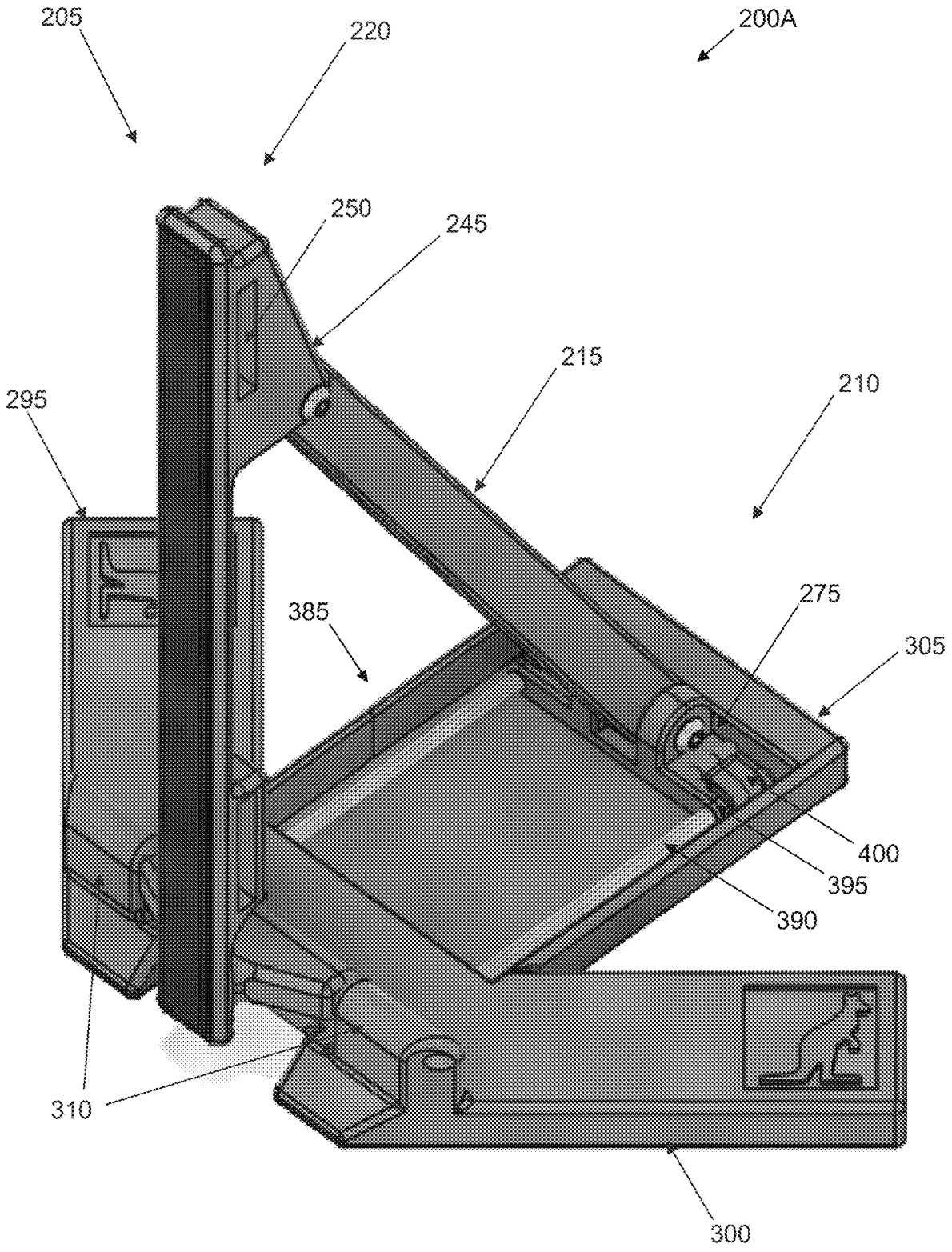
FIGS. 31 and 32 are schematic views showing another form of the device shown in FIGS. 17-27.
Figure 32:
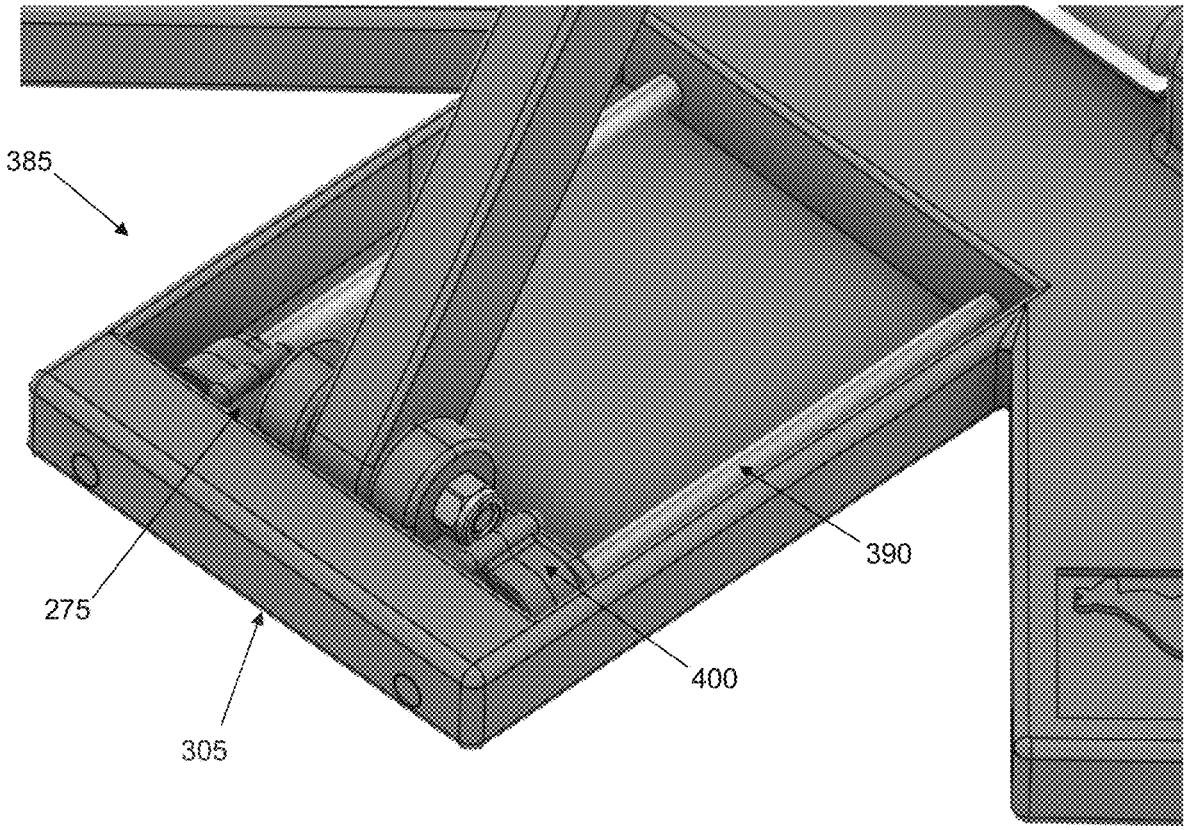
Figure 33:
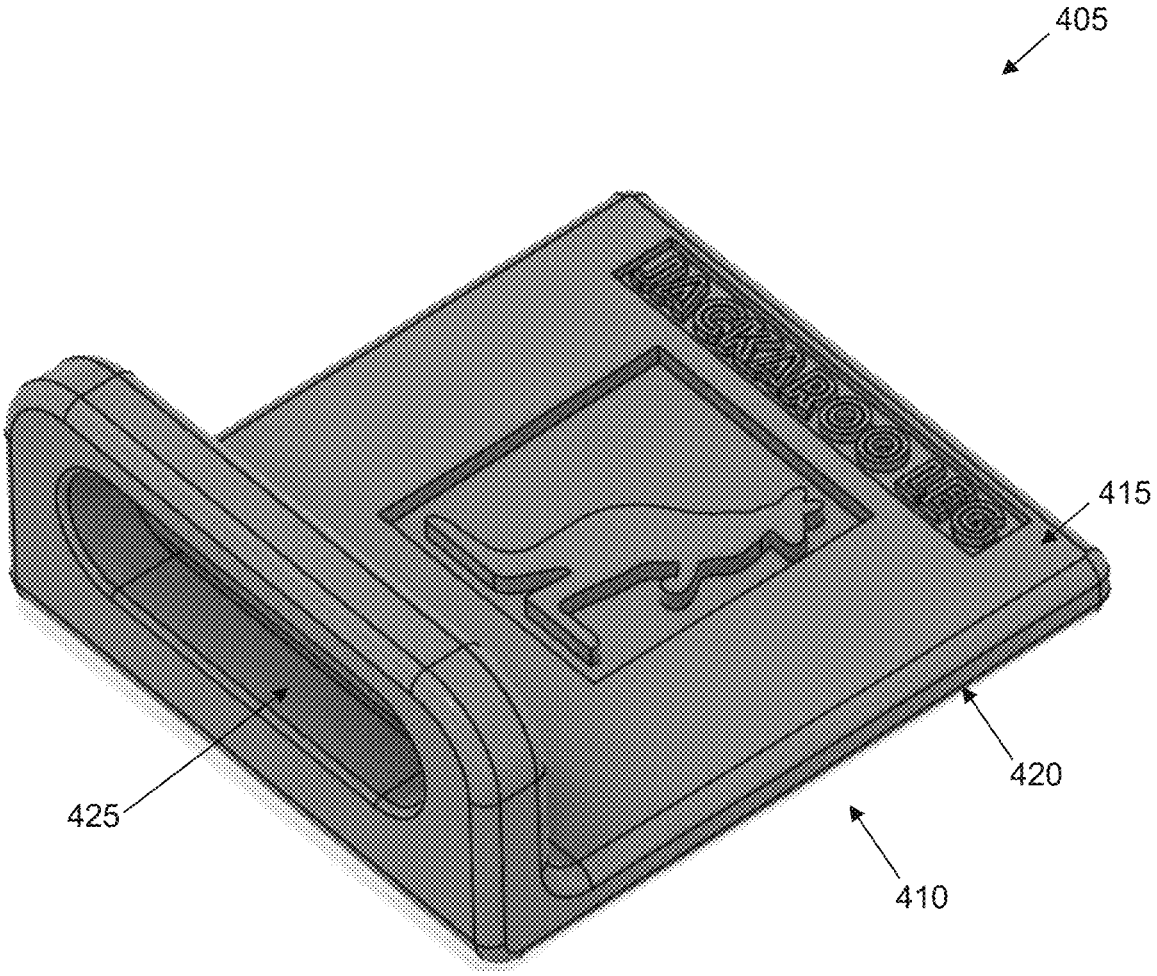
FIGS. 33-36 are schematic views showing a device for attaching a chair to a table formed in accordance with the present invention.
Figure 34:
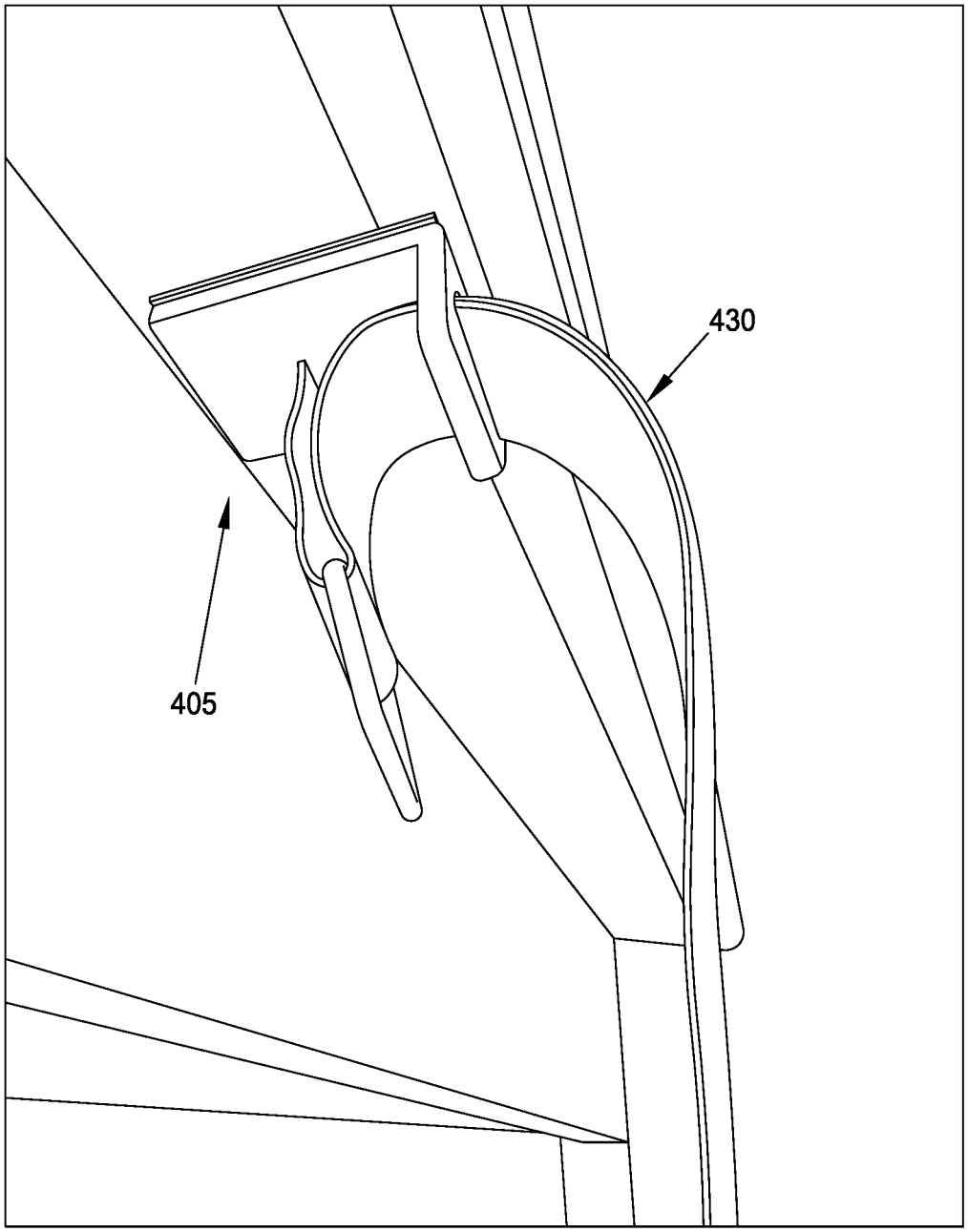
Figure 35:
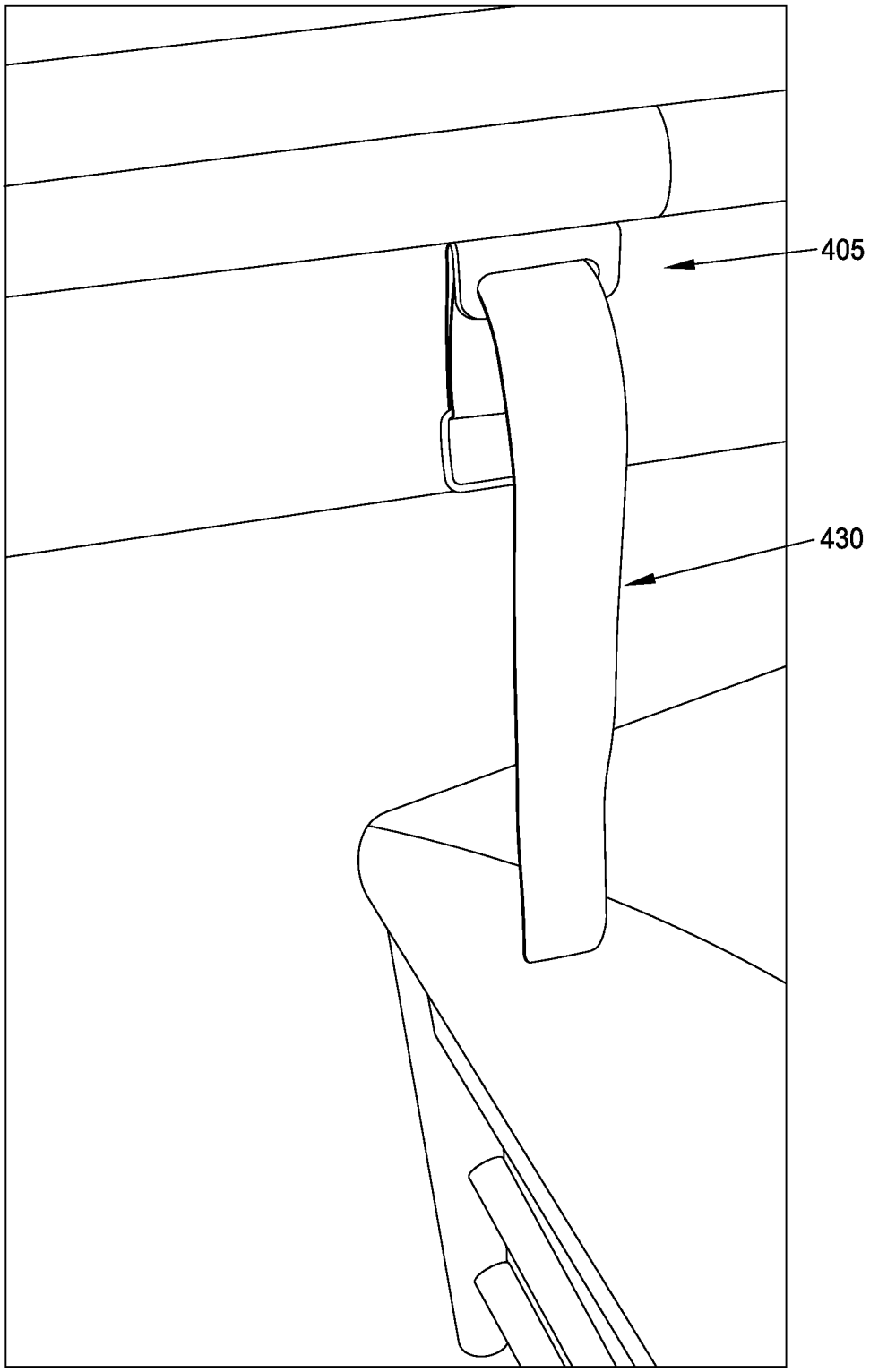
Figure 36:
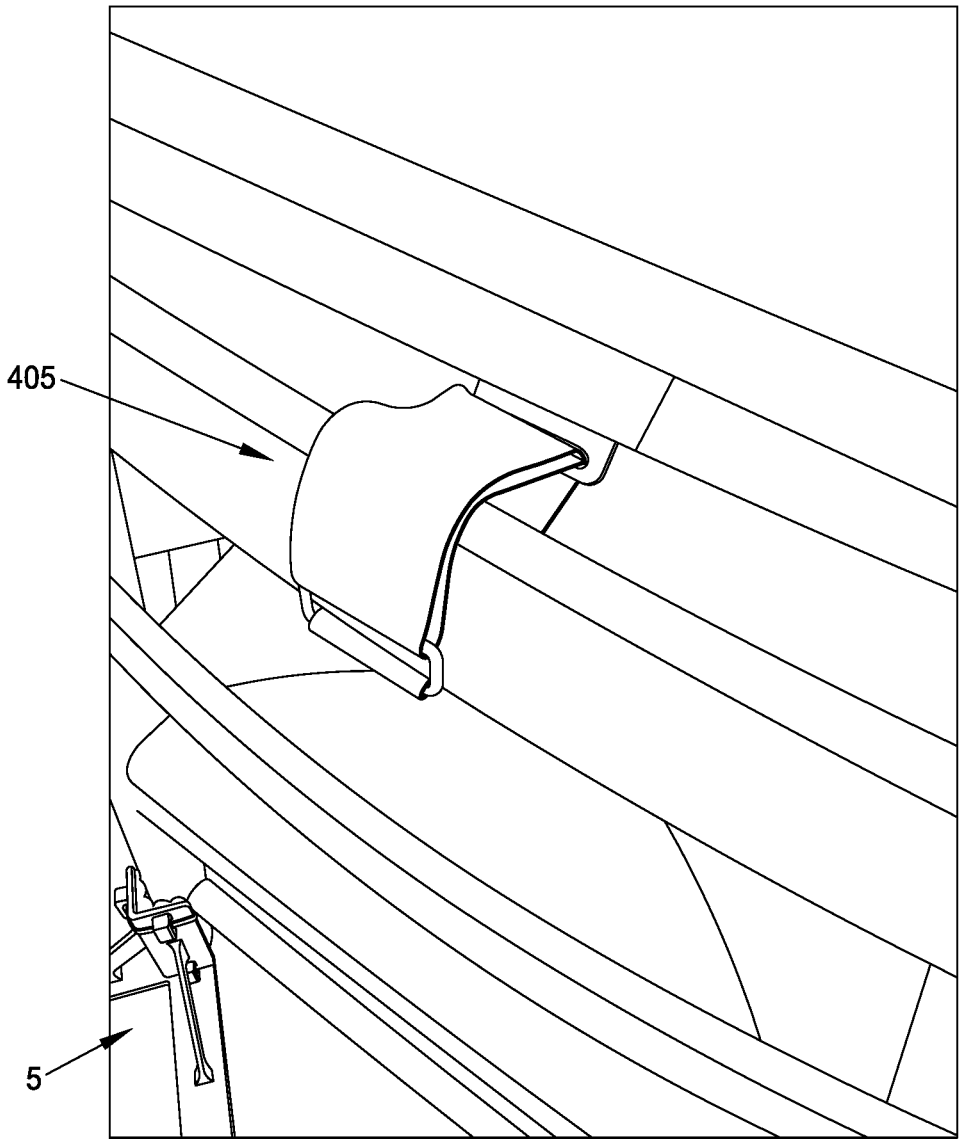

More particularly, in addition to the sliding slot configuration of devices 5A and 5B, and the lock mechanism configuration of device 200, discussed above, a device 200A may be provided. Looking now at FIGS. 31 and 32, device 200A is similar to device 200 except that lock mechanism 217 and ribbed racks 325 of track 305 are not provided, and mount 275 of stabilization arm 215 has a different configuration. In this form of the invention, there is provided a pole system 385 for allowing mount 275 to slide in track 305 (and hence change the angle of upright portion 205). Pole system 385 may comprise at least one pole 390 for tracking and securing stabilization arm 215 to base portion 210. Mount 275 of stabilization arm 215 comprises at least one slider 395 configured to move along the at least one pole 390. Mount 275 may be secured in position along the at least one pole 390 with locking tabs 400 (or other means known in the art).

It should be appreciated that any of the aforementioned means for allowing movement of the stabilization arm in the track of the base portion of a device, or any other means for allowing movement of the stabilization arm which will be apparent to one of skill in the art in view of the present disclosure, may be used with any of the devices disclosed herein. In other words, the device is not limited to the means specifically disclosed with respect to a particular embodiment (i.e., devices 5A, 5B and 200 may use any means disclosed herein for moving the stabilization arm in the track of the base portion and any other means apparent to one of skill in the art in view of the present disclosure).

Furthermore, it should also be appreciated that any of the aforementioned lock mechanisms or such other lock mechanisms which will be apparent to one of skill in the art in view of the present disclosure may be used with the present invention.

Chair Stabilization System

The present invention also comprises the provision and use of a table connector that may be used in conjunction with the stabilization devices of the present invention.

More particularly, and looking now at FIGS. 33-36, there is shown a table connector 405 formed in accordance with the present invention.

Table connector 405 comprises a base 410 having a first side 415 and a second side 420 and a raised slot 425 on first side 415 of base 410. Base 410 comprises an adhesive (not shown) on second side 420. The adhesive may comprise a pressure sensitive adhesive, double sided Velcro®, etc. for securing table connector 405 to the underside of a table (see FIGS. 34 and 35). A strap 430 (e.g., Velcro®, cable ties, etc.) is slid through raised slot 425 and around the seat back of a chair (see FIG. 36) and fastened so as to secure a chair to the table. Thus, a chair cannot be pulled out from the table when table connector 405 is in place.

Modifications

While the present invention has been described in terms of certain exemplary preferred embodiments, it will be readily understood and appreciated by those skilled in the art that it is not so limited, and that many additions, deletions and modifications may be made to the preferred embodiments discussed above while remaining within the scope of the present invention.

What is claimed is:

1. A stabilization device for preventing an object from falling backwards or sideways, the device comprising:

an upright portion comprising an inner surface and an outer surface;

a base portion mounted to the upright portion comprising at least one leg; and a stabilization arm, wherein the stabilization arm is mounted to the upright portion and the base portion;

wherein an angle of the upright portion is adjustable;

wherein the base portion further comprises a track and the stabilization arm comprises a mount configured to move in the track so that when the mount is moved within the track, the angle of the upright portion changes; and wherein the base portion comprises a first leg and a second leg and the track is disposed between the first leg and the second leg.

2. A device according to claim 1 wherein the inner surface is configured for placement on a leg of an object and the base portion is configured for placement on a floor.

3. A device according to claim 1 wherein the outer surface of the upright portion comprises at least one strap bridge configured to receive a strap.

4. A device according to claim 1 wherein the base portion comprises at least one rounded edge.

5. A device according to claim 1 wherein the first leg and the second leg are flexible.

6. A device according to claim 1 wherein the device further comprises a lock mechanism for securing the mount of the stabilization arm in the track.

7. A device according to claim 6 wherein the lock mechanism is releasably secured to the base portion via a fastener.

8. A device according to claim 1 wherein the inner surface of the upright portion comprises a gripping material.

9. A device according to claim 8 wherein the gripping material comprises at least one from the group consisting of a foam pad, tape, a double sided hook-and-loop fastener and furniture pad material.

10. A method for stabilizing an object, the method comprising:

providing a stabilization device, the stabilization device comprising:

an upright portion comprising an inner surface and an outer surface;

a base portion mounted to the upright portion comprising at least one leg; and a stabilization arm, wherein the stabilization arm is mounted to the upright portion and the base portion;

wherein an angle of the upright portion is adjustable;

wherein the base portion further comprises a track and the one stabilization arm comprises a mount configured to move in the track so that when the mount is moved within the track, the angle of the upright portion changes; and wherein the base portion comprises a first leg and a second leg and the track is disposed between the first leg and the second leg;

positioning the inner surface of the upright portion on an object; and securing the stabilization device to the object.

11. A method according to claim 10 further comprising adjusting the angle of the upright portion before securing the stabilization device to the object.

12. A method according to claim 10 wherein the inner surface is configured for placement on a leg of an object and the base portion is configured for placement on a floor.

13. A method according to claim 10 wherein the outer surface of the upright portion comprises at least one strap bridge configured to receive a strap.

14. A method according to claim 10 wherein the base portion comprises at least one rounded edge.

15. A method according to claim 10 wherein the first leg and the second leg are flexible.

16. A method according to claim 10 wherein the device further comprises a lock mechanism for securing the mount of the stabilization arm in the track.

17. A method according to claim 16 wherein the lock mechanism is releasably secured to the base portion via a fastener.

18. A method according to claim 10 wherein the inner surface of the upright portion comprises a gripping material.

19. A method according to claim 18 wherein the gripping material comprises at least one from the group consisting of a foam pad, tape, a double sided hook-and-loop fastener and furniture pad material.

20. A chair stabilization system comprising:

an adjustable upright portion comprising an inner surface and an outer surface, wherein the inner surface is configured for placement on a chair leg and the outer surface comprises at least one strap bridge configured to receive a strap;

a base portion hingedly mounted to the upright portion comprising a first leg, a second leg and a track disposed in between the first leg and the second leg, wherein the base portion is configured for placement on a floor;

a stabilization arm hingedly mounted to the upright portion comprising a mount configured to be releasably secured in the track of the base portion; and at least one strap configured to be held by the at least one strap bridge for securing the system to a leg of a chair.

21. A system according to claim 20 wherein the base portion comprises at least one rounded edge.

22. A system according to claim 20 wherein the first leg and the second leg are flexible.

23. A system according to claim 20 wherein the system further comprises a lock mechanism for securing the mount of the stabilization arm in the track.

24. A system according to claim 23 wherein the lock mechanism is releasably secured to the base portion via a fastener.

25. A system according to claim 20 wherein the inner surface of the upright portion comprises a gripping material.

26. A system according to claim 25 wherein the gripping material comprises at least one from the group consisting of a foam pad, tape, a double sided hook-and-loop fastener and furniture pad material.

* * * * *